US006049448A

United States Patent [19]

Lanigan et al.

[11] Patent Number: 6,049,448

[45] Date of Patent: Apr. 11, 2000

[54] SECURITY SYSTEM FOR ROLL DOWN DOORS

[76] Inventors: William P. Lanigan, 16946 Blue Heron Dr.; James B. Davis, 9200 Christine Ct., both of Orland Park, Ill. 60462; Peter W. Mirabella, 7647 Starling Dr., Schererville, Ind. 46375

[21] Appl. No.: 08/822,436

[22] Filed: Mar. 21, 1997

Related U.S. Application Data

[63] Continuation-in-part of application No. 08/692,374, Aug. 5, 1996, Pat. No. 5,781,399.

[51] Int. Cl.[7] ..... H01H 47/02

[52] U.S. Cl. ..... 361/172; 70/278

[58] Field of Search ..... 361/155, 156, 361/170, 171, 172; 70/277, 278; 200/19 L; 307/10.2; 105/395

[56] References Cited

U.S. PATENT DOCUMENTS

| | | | |
|---|---|---|---|
| 3,933,382 | 1/1976 | Counts et al. | 292/144 |
| 4,013,930 | 3/1977 | Geller | 361/172 |
| 4,083,424 | 4/1978 | Stemmen et al. | 180/289 |
| 4,161,870 | 7/1979 | Barnes | 70/278 |
| 5,268,811 | 12/1993 | Maeda | 361/172 |
| 5,388,435 | 2/1995 | Bailey | 70/101 |
| 5,490,031 | 2/1996 | Braun et al. | 361/93 |
| 5,532,521 | 7/1996 | Leininger | 307/10.2 |
| 5,781,399 | 7/1998 | Lanigan et al. | 361/172 |

*Primary Examiner*—Jeffrey Gaffin
*Assistant Examiner*—Kim Huynh

[57] ABSTRACT

A security system with a driver circuit for energizing a solenoid actuated locking device. The circuit can include a microprocessor, a battery power supply, a boosting circuit and an energy storage circuit. The battery voltage can be stepped up by the boosting circuit and the stepped up voltage can be stored in the energy storage circuit. A solenoid driver circuit including a plurality of transistors arranged in an H-bridge configuration supply energy from the storage circuit to the solenoid under control of the microprocessor. The security system can be retrofited or is factory installable, and is particularly adapted for roll down doors and enclosures.

10 Claims, 17 Drawing Sheets

332
322

324

332
326

322

Fig 25
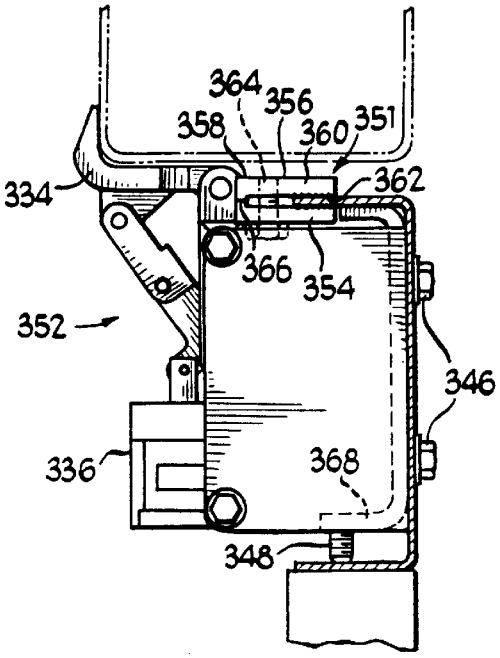
Fig 26
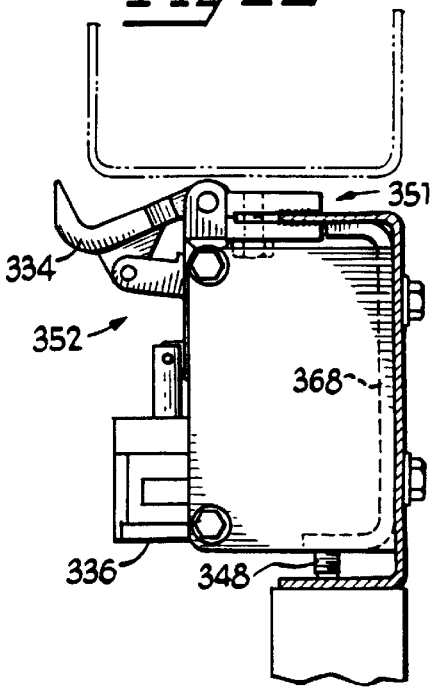
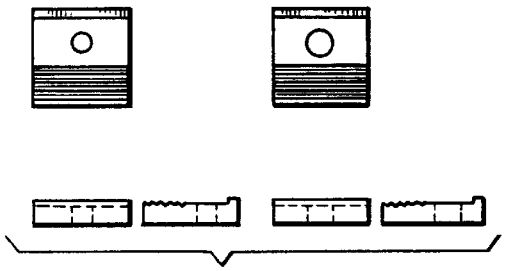
Fig 27
Fig 28
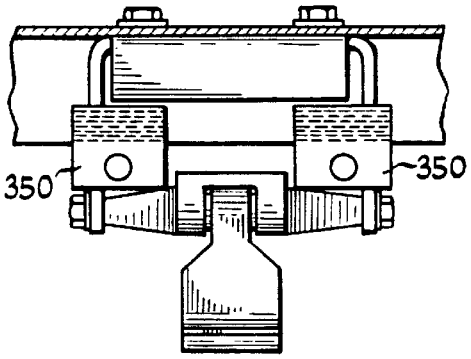
Fig 29
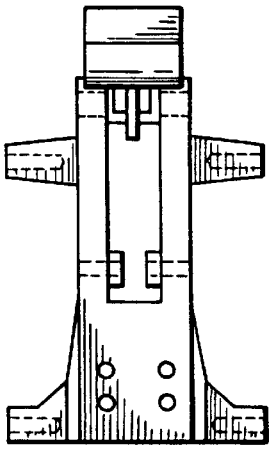

SECURITY SYSTEM FOR ROLL DOWN DOORS

This application is a continuation-in-part application of Ser. No. 08/692,374 filed Aug. 5, 1996, now U.S. Pat. No. 5,781,399.

FIELD OF THE INVENTION

This invention relates to security systems, and particularly to retrofitable and factory installable security system for roll down doors and enclosures.

BACKGROUND OF THE INVENTION

FIG. 1 shows the back of a conventional semi-trailer or cargo container 10 or other similar enclosed body, preferably in the form of an International Standards Organization (ISO) container, domestic container or semi-trailer, having a pair of doors 12 and 14, hinged along their outer edges at 16 and 18 to opposite vertical sides 20 and 22 of door frame or opening 24. Thus, doors 12 and 14 are mounted for relative rotation in opposite directions around sides 20 and 22 between a closed position as shown in FIG. 1, and an open position. When either or both doors 12 and 14 are open, ready access is provided through door opening 24 to load or unload cargo into or out of the trailer or container 10.

When doors 12 and 14 are closed, an overlapping tab (door retainer) which can be internal or external to the doors, can be used. In use, door 12 is closed first and thereafter door 14 is closed to overlap and hold door 12 closed. Typically, an overlapping tab (door retainer) which is external to the doors can be used to overlap door 12. Subsequently, door 14 is typically opened first before door 12 can be rotated to the open position.

Carried by each door is a conventional closure assembly of any number of axially rotatable rods 30, suitably journaled in upper and lower brackets 32 and 34 on the door and provided with a handle 36. The upper and lower ends of the rod 30 engage with cam members 38 and 40 and bring the door to a fully closed position as the handle 36 and attached rod 30 are manually rotated to the position in FIG. 1. When in this position, a padlock or the like can be used to keep handle 36 and attached rod 30 in the closed position, as shown.

Accordingly, the manually operable closure means (rod 30, brackets 32 and 34, handles 36 and cam members 38 and 40) are located on the exterior of the container 10 where they are readily accessible by authorized and unauthorized workers and drivers, as well as would be thieves intent on stealing products and goods which may be contained in the semi-trailers and similar bodies and like enclosures. Previously, the security for these trailers, ISO containers, domestic containers and the like has been quite poor, usually consisting of a padlock and/or seal having an exposed link which can be cut by bolt cutters or equivalent tools. Thus, semi-trailers, containers and trucks left unattended for any length of time, as over night in truck terminals, intermodal terminals and freight yards, on shipping docks and piggy-back railroad cars, or at industrial or commercial loading areas (and during transit), are vulnerable to thievery and pilferage.

The problem of vulnerability of externally located closure means is minimized by the present invention, through the employment of a retrofitable or factory installed security system adapted to be located within a container, where it is not accessible to a would be thief or opportunist.

There is a need for a security system adapted to be located within a container, where it is not accessible to a would be thief or opportunist.

There is an ever demanding requirement for improved security systems for cargo loading doors and enclosures for the worldwide transportation industry.

Solenoid actuated locking devices are known and find numerous applications. An example is the locking of doors. In such an application, a locking mechanism is adapted to a solenoid which is secured either to the door or the door jamb. Selective energization of the solenoid drives a lock actuator for effecting actuation of the locking mechanism and securely locking the door. The components of the solenoid locking system may be completely contained within the door system to resist tampering.

One consideration when employing a solenoid locking system is the source of energy for driving the solenoid device, typically electrical energy. Where the solenoid locking device is contained within doors of a building, obtaining and providing a sufficient source of electrical energy is not a problem. The system is simply tied into the building electrical system. However, a sufficient source of electrical energy may not always be readily available.

Because of its superior locking capability, solenoid locking devices have been adapted to cargo containers, storage containers, over-the-road truck trailers and other similar type cargo carrying containers. In some instances, there is a source of electrical energy nearby, such as from the electrical system of the tractor. However, often the container, storage container, trailer or similar enclosure, will be remotely located from a source of electrical energy. To provide electrical energy for actuating the solenoid locking device, the container is provided with a battery for supplying electrical energy to the solenoid.

One disadvantage of using a battery as a source of electrical energy for the solenoid is its limited supply of energy. Unless care is taken to preserve battery energy the battery may be discharged to a state in which it will no longer provide sufficient electrical energy to operate the solenoid. Another disadvantage of battery systems is the limited electrical potential of the battery. Unless the battery contains a large number of cells, and hence is a very large battery, its electrical potential (voltage) is relatively low limiting the size of the solenoid which may be effectively driven by the battery. Use of a smaller solenoid dictates use of smaller locking components, and hence, provides less security. Larger batteries do not provide a sufficient solution because of their size and cost.

Unlike buildings which to some degree allow for protecting the solenoid locking device from the environment, the device incorporated into a shipping container will experience large changes in environmental conditions. Thus, the solenoid actuated locking device fitted to a container must further adapt and adjust its operating characteristics in response to changes in temperature.

Therefore, there is a need for a solenoid locking device which may be operated using a battery source of energy yet which provides substantial electrical potential for actuating the solenoid. The device must also compensate for varying operating conditions as a result of changing environmental conditions and preserve battery energy.

SUMMARY OF THE INVENTION

The present invention provides a solenoid actuated locking device in which a lock actuation member is coupled with a solenoid. The solenoid is adapted to move the lock actuation member between a locked state and an unlocked state. Energy is supplied to the solenoid by a solenoid driver circuit coupled to the solenoid and to an energy storage circuit. A power supply couples a source of electrical energy to the energy storage circuit. An input interface receives a user signal and provides an output signal to a controller. The controller provides signals to the solenoid driver circuit to cause selective energization of the solenoid in response to the output signal.

In another embodiment of the present invention, the input interface is one or more of a radio-frequency device, an electro-mechanical switch, a proximity sensor, a photoelectric sensor and a pushbutton. Moreover, the device may be adapted to include a transceiver which receives status signals from the controller and communicates them to a remote location.

As another aspect of the invention, the solenoid driver circuit is a plurality of transistors arranged in an H-bridge configuration. Preferably the transistors are MOSFETs.

In yet another aspect of the present invention the power supply includes a battery coupled to a voltage boosting circuit. The power supply may further include a voltage regulator coupled to the battery and to the controller and a battery isolation circuit coupled between the battery and the voltage boosting circuit and further coupled to the controller.

In still another aspect of the invention a sleep mode is provided for the controller in that it is enabled upon receipt of the user signal at the input interface.

In another aspect of the present invention at least one sensor is coupled to sense a state of the lock actuation member and to provide a signal to the controller indicative of the state of the lock actuation member. The invention may also include at least one sensor coupled to detect an environmental condition of the lock actuation member and to provide a signal to the controller indicative of the environmental condition.

A still further aspect of the present invention provides a circuit for selectively energizing a solenoid actuated locking device. The circuit includes an input circuit adapted to receive a user signal and to provide an output signal to a controller. A plurality of transistors configured in an H-bridge are coupled to the solenoid and to an energy storage device. A power supply provides energy to the energy storage device. The controller is coupled to the transistors for selectively activating and deactivating the transistors for communicating electrical energy from the energy storage device to the solenoid.

BRIEF DESCRIPTION OF THE DRAWINGS

FIGS. 25 and 26 are elevated partial side views of the security system with an alternate embodiment of the universal adapter having gripping structure adapted to secure a locking assembly with respect to a door, the locking assembly has a latch shown in a locked and unlocked position, respectively, in accordance with the present invention;

FIG. 27 is a partial view of the gripping structure showing an embodiment of the individual plates in FIGS. 25 and 26, in accordance with the present invention;

FIG. 28 is a top view of the universal adapter showing dual gripping structures adapted to secure a locking assembly with respect to a door, the locking assembly has a latch, in accordance with the present invention;

FIG. 29 is a partial view of the locking assembly adapted to be used in connection with the adapter in FIGS. 25–28, in accordance with the present invention:

DETAILED DESCRIPTION OF THE PREFERRED EMBODIMENT

Referring to the figures, a retrofitable or factory installable security system 50 is shown. The security system 50 is particularly adapted for cargo loading doors for cargo containers, ISO containers, domestic containers, truck trailers and the like (hereafter referred to as "containers"). Placement of system 50 may vary from the position (top right) shown in FIG. 1 and the other figures, the placement shown in the figures being a preferred placement to minimize the possibility of breakage during loading and unloading of cargo.

Figure 5:
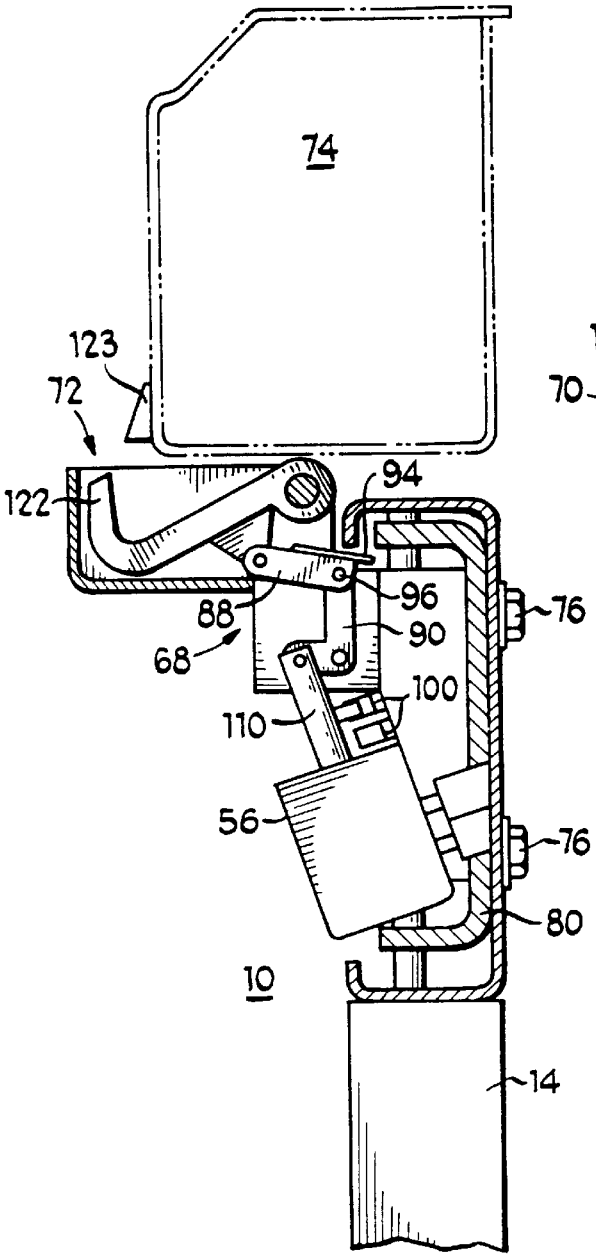
FIG. 5 is a cut away view taken along the lines 5—5 in FIG. 2, of a portion of the security system showing the latching device in a relaxed position (or a portion of a lock assembly in an unlocked position), in accordance with the present invention.
Figure 6:
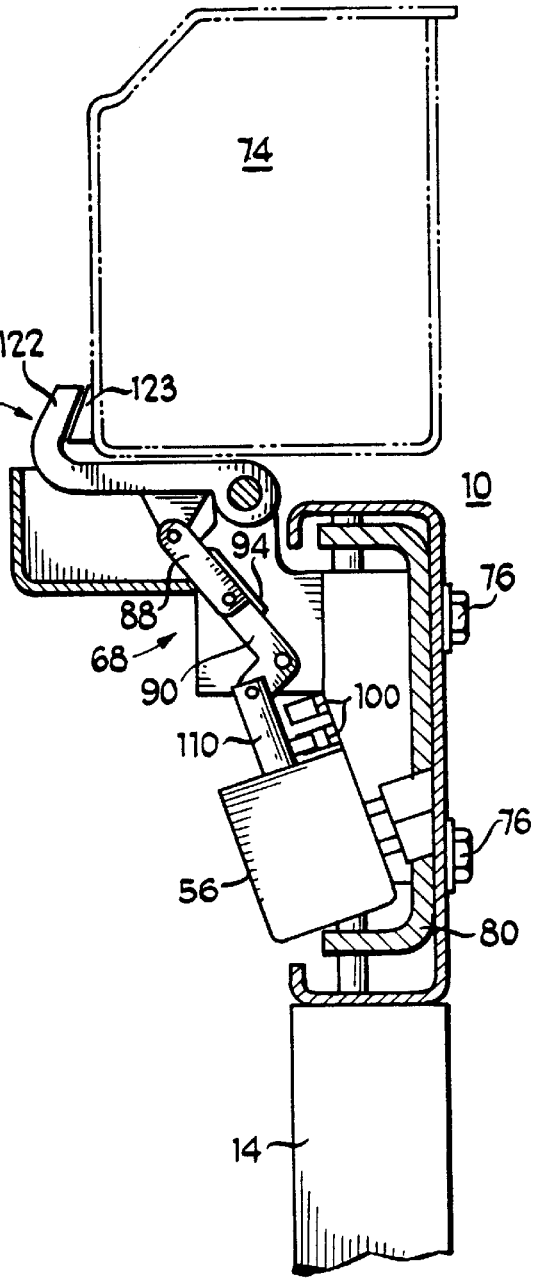
FIG. 6 is a cut away view taken along the lines 5—5 in FIG. 2, of a portion of the security system showing the latching device in a raised position (or a portion of the lock assembly in a locked position), in accordance with the present invention.
Figure 8:
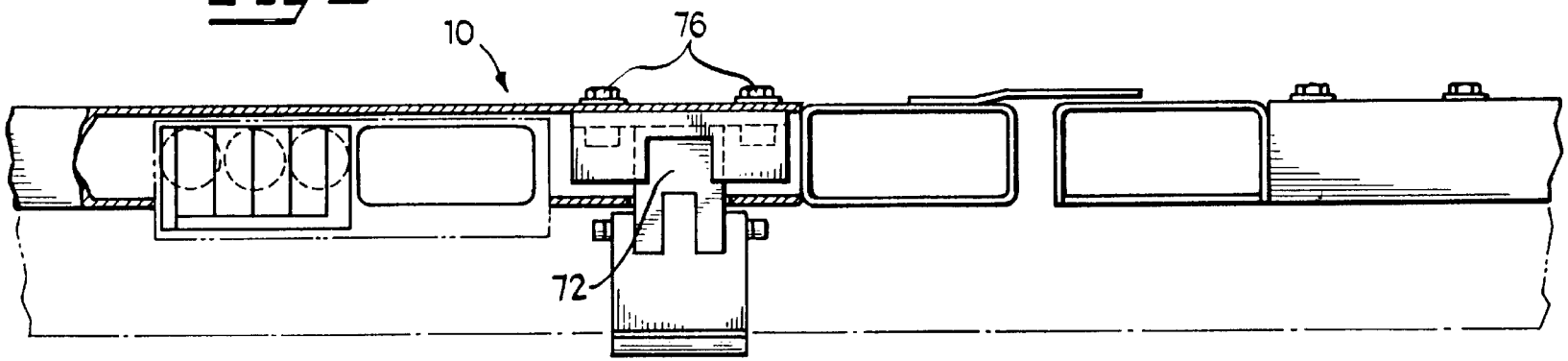
FIG. 8 is a top view of a portion of the security system in FIGS. 1–7, in accordance with the present invention.

The security system 50 in its simplest form, comprises: a remote transmitter 52 for transmitting a radio signal; a receiver 54 for receiving the radio signal from the remote transmitter 52; an electro-mechanical actuator 56 coupled to the receiver 54 for moving a latching device 66 between a locked position and an unlocked position; and a lock assembly 58 including a housing 64 for holding the electro-mechanical actuator 56, a latching device 66 pivotably connected to the housing 64, and a linkage mechanism 68 coupling the electro-mechanical actuator 56 and the latching device 66 for moving the latching device 66 to and from a raised position 70 to a relaxed position 72, whereby the latching device 66 is movable between the locked position, as shown in FIG. 6, and unlocked position, in FIG. 5, respectively.

In one embodiment, the remote transmitter and receiver can each be transceivers, for an improved intelligent communication system. The system can provide, but is not limited to, for storage, identification, memory and interrogation of the system 50. For example, this feature could provide a history of all door openings, closings and tamperings of the system 50.

This system is configured to be tamper resistant because of it's placement which is preferably internal to a container. In addition, system 50 has been designed in a preferred embodiment to have a low profile to minimize intrusion into the valuable cargo space of the container. In one embodiment, only one latching mechanism is necessary to lock two doors when utilized with a door retainer or the like, providing simplicity of design. As should be understood, other embodiments can include a plurality of latching mechanisms.

Figure 1:
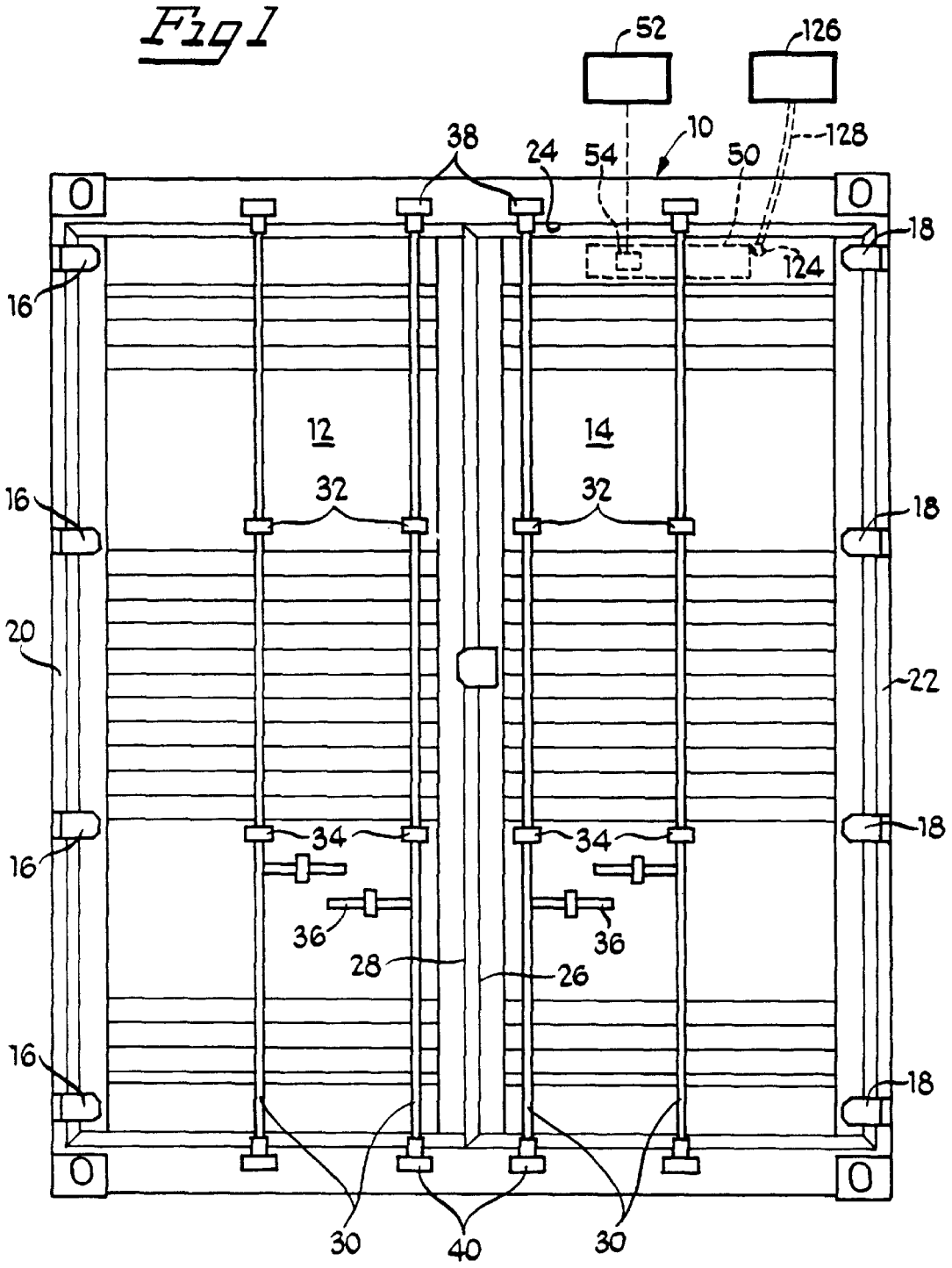
FIG. 1 is a rear view of an ISO container or other similar enclosed body, showing in dashed line a typical placement of part of a security system for cargo loading doors, in accordance with the present invention.

In a preferred embodiment, the housing 64 is adapted to be connected to an inside of a cargo loading door, such as positioned at the top right corner, as shown in dashed line as item 50 in FIG. 1. This remote placement is out of the way so as not to interfere with the loading and unloading operation. Thus, this strategic position provides a substantially tamper proof security system, preferably with internal placement of system 50, so as to be visually hidden from an opportunist or thief.

Also in a preferred embodiment, the latching device 66 is particularly adapted to latch to a header 74 of an ISO container 10 when the latching device 66 is in the locked position 60 and unlatched from the header 74 when the latching device 66 is moved to the unlocked position, as shown in FIGS. 5 and 6. By utilizing a header of a container to lock the doors, a retrofittable or factory installable system 50 is easily installed, thus minimizing the need for cutting, drilling or welding during installation.

Figure 4:
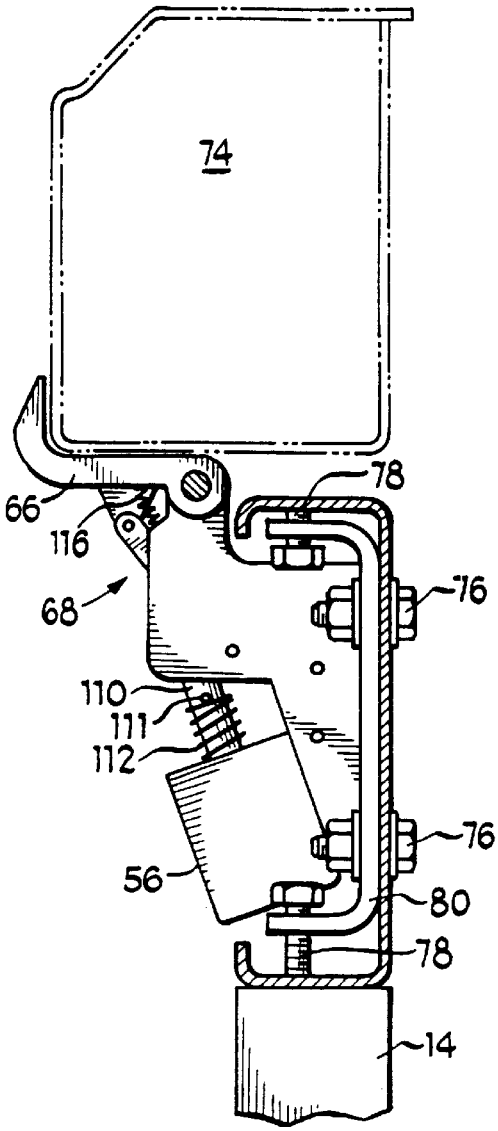
FIG. 4 is a side view taken along the lines 4—4 in FIG. 2 without a cover, of a portion of the security system, in accordance with the present invention.

In one embodiment as shown in FIG. 4, the housing 64 can include primary connecting devices 76, or fastening means such as bolts and nuts extending through the door and attach a portion of the system 50 to the inside door 14. Also, secondary connecting devices or supplemental fastening means such as set screws or bolts applying outward axial pressure can be used, to define a secondary securement mechanism between the housing 64 and the cargo loading door 14. The primary connecting devices 76 provide accuracy and consistency in placement, location and alignment of a portion of the system 50. Further, the secondary connecting devices 78, in the event of removal of the primary devices 76 (during a break in), continue to secure and maintain the system 50 at the desired position.

Figure 9:
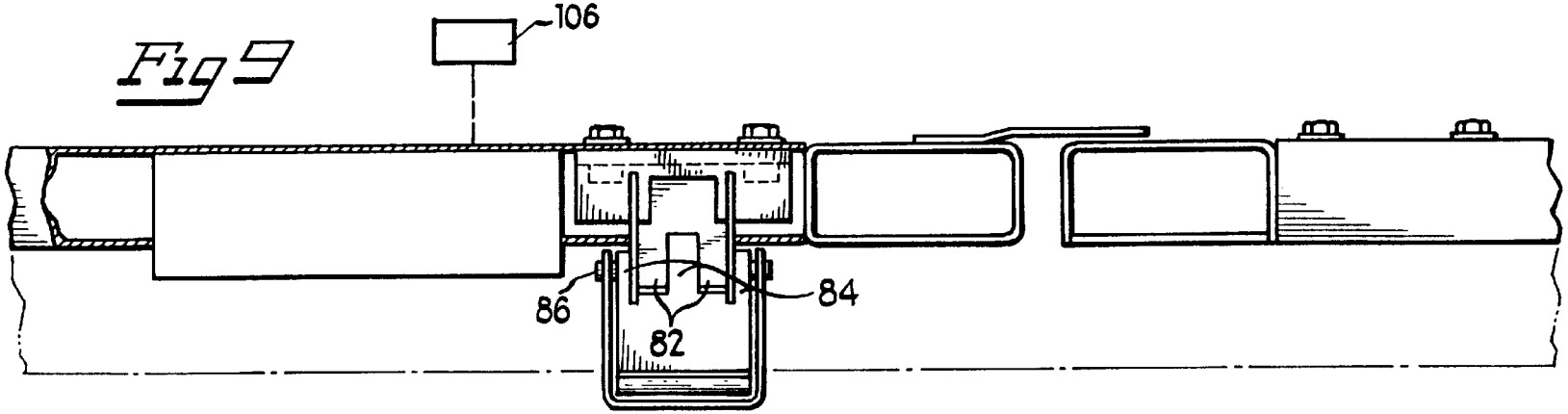
FIG. 9 is a top view of a portion of the security system in FIGS. 1–7 with an optional external antenna, in accordance with the present invention.

As best shown in FIG. 9, the housing 64 can further include a back plate 80 with a plurality of outwardly extending anchor members 82, which are adapted to be coupled with a plurality of hinge members 84 of the latching device 66, via a pivot pin 86. Advantageously, this structure allows the lock assembly 58 to easily move from the locked position 60 to the unlocked position. This structure also allows for variations in door and frame geometries.

As illustrated in FIGS. 5 and 6, the linkage mechanism 68 includes an elongated distal section 88 and an L-shaped proximal section 90, the distal section 88 is coupled to the latching device 66 and a short leg 92 of the L-shaped proximal section 90 is couplable with the electro-mechanical actuator 56. This structure provides the advantages of converting minimal linear motion to angular motion required to move the latching device 66 from the locked to the unlocked position and vice versa. Advantageously, it also simulates a rigid link thus holding the latch 66 in its locked position and diverting any forces from the electro-mechanical actuator 56 to the housing 64, for improved strength and integrity. Additionally, in this position the system 50 is self locking and requires essentially no battery power, thus minimizing battery drain.

In one embodiment, the elongated distal section 88 includes a stop tab 94. The stop tab 94 properly aligns the linkage mechanism 68 beyond center with respect to the proximal section 90 to simulate a rigid link securing the latching device 66 in its locked position, in FIG. 6.

The L-shaped proximal section 90 and the elongated distal section 88 are couplable with a pivot pin 96. The pivot pin 96 allows rotation and transfer of motion through the distal section 88 to the latching device 66.

As shown in the figures, the L-shaped proximal section 90 is pivotably connected to the anchor members 82 of the housing via a stationary pivot pin 98. The pivot pin 98 is significant in the conversion of linear to angular motion, and maintaining a simulated rigid link. It is connected to a middle portion of the anchor members 82 of the housing 64. This allows a minimal amount of displacement from the electro-mechanical actuator 56 to move and rotate the latching device 66.

As best shown in FIGS. 5 and 6, the electro-mechanical actuator 56 can include one or more sensors 100 for sensing whether the lock assembly 58 is in the locked or unlocked position. In the event that the latching device 66 is not in a position after a given command, from the remote transmitter 52, the sensor(s) 100 can provide a signal that will allow re-execution automatically after a predetermined time, for example. In addition, this structure can provide feedback in order to give positioning data as to internal location of the latching device 66.

In one embodiment, the security system 50 includes an electronic control 102 or interface structure, coupled to the receiver 54 and the electro-mechanical actuator 56. This structure interprets the transmitted information to suitably execute an open or close command, for example. Advantageously, this structure can receive information from the remote transmitter 52 without the necessity of an external power source other than the batteries or power supplies 108 shown in the figures. Also, this structure 102, like most of the other components of the security system 50, has a narrow width or profile so as to minimally intrude into the valuable cargo space.

Figure 2:
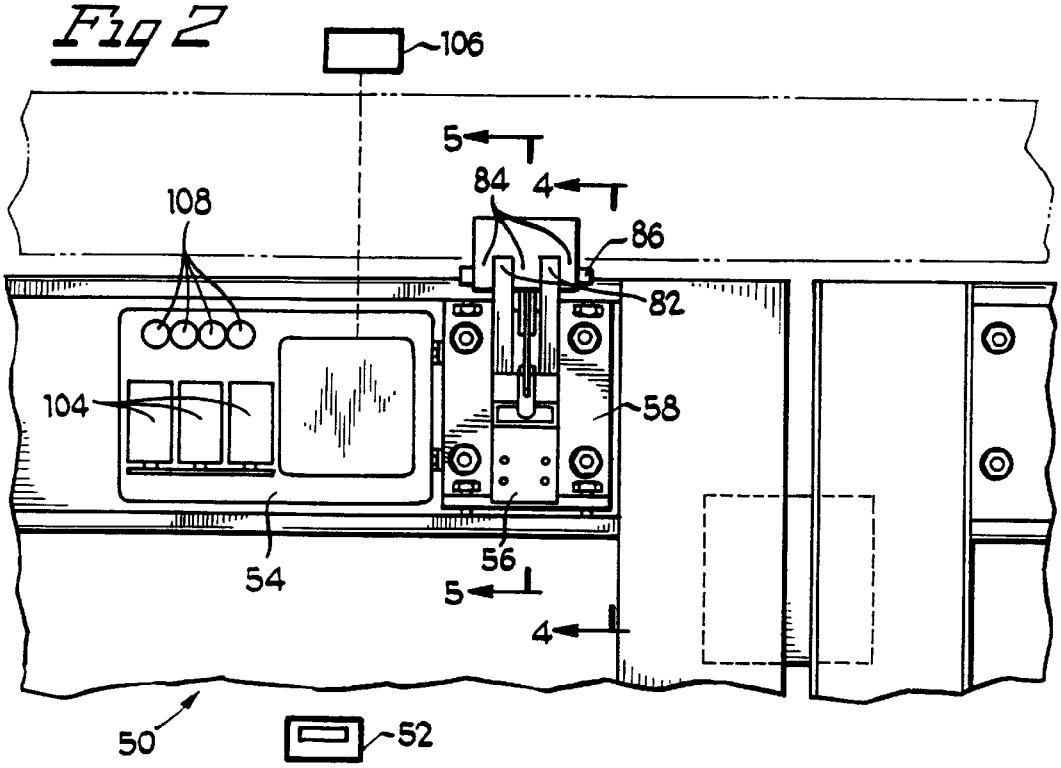
FIG. 2 is an inside view of part of the security system, without a cover (to show the placement of some of the various components) and a remote transmitter, in accordance with the present invention.
Figure 3:
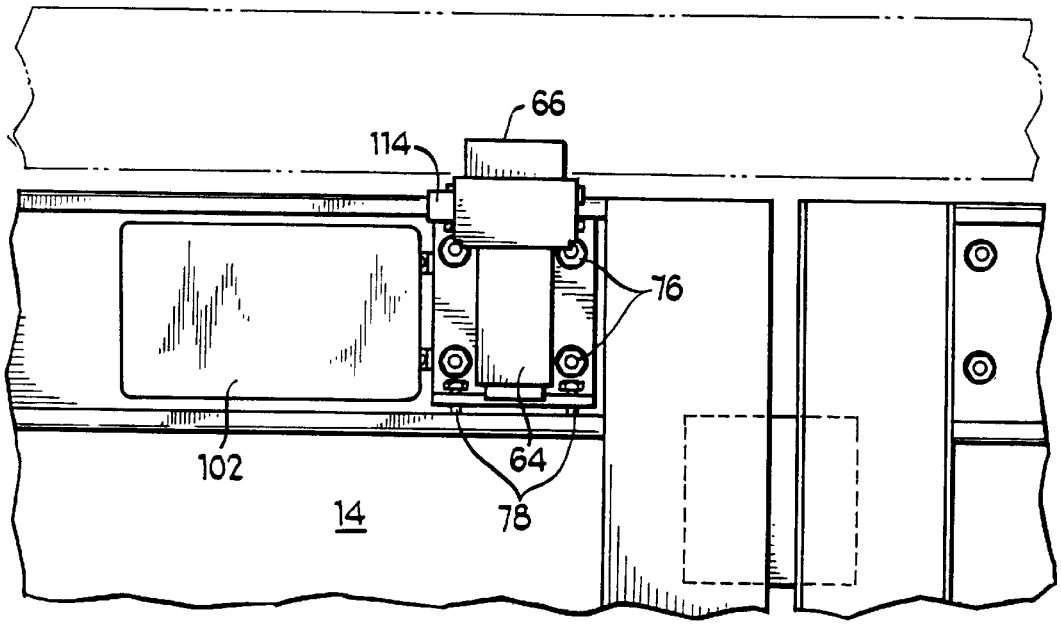
FIG. 3 is an inside view of part of the security system, with a cover which protects many of the components, in accordance with the present invention.

As shown in FIG. 2, the security system 50 includes an electronic control or interface structure 102 coupled to the receiver 54 and the electro-mechanical actuator 56, capacitor(s) 104, an antenna 106 and power supplies 108. The capacitors 104 suitably build-up and store energy to rapidly release an electrical charge, to actuate the electro-mechanical actuator 56, to appropriately move a plunger 110. This provides an efficient use of the energy supplied by the power supply 108, preferably in the form of batteries. The antenna can vary widely depending on the application, and can be of a conventional type or patch type, for example. In a preferred embodiment, the antenna is placed internal to a container to keep it hidden and minimize the possibility of damage, and is operably coupled to the system 50, for suitable reception of a signal. In another embodiment, the antenna could be external, if desired.

In a preferred embodiment, a sensor, such as but not limited to, a proximity sensor 114 can be utilized to allow the latch to be actuated only when a door 14 is in proximity to a metallic material, such as a header 74. Thus, this feature can help to minimize damage to the latching device 66, when closing the door with the latching device 66 in a locked position. The sensor 114 is suitably connected to the other components of the security system 50, for example 54, 56, and 64 and is preferably physically connected to and in proximity of the latch 66, for accurate sensing.

In FIG. 4, the electro-mechanical actuator 56 includes a plunger 110, a snap ring 111 and a spring 112. The spring provides an outward force to bias the plunger 110 to an extended position when the plunger 110 is released.

A second spring 116 is shown in FIG. 4, and can be used to help push (bias) the latch 66 to the locked position if desired. The spring can help to contribute to minimizing current drain and facilitating movement to the locked position. It is strategically and physically located between the latching device 66 and anchor member 82 of the housing 64 so as not to require more space, thus providing minimal space requirements for the system 50.

Figure 7:
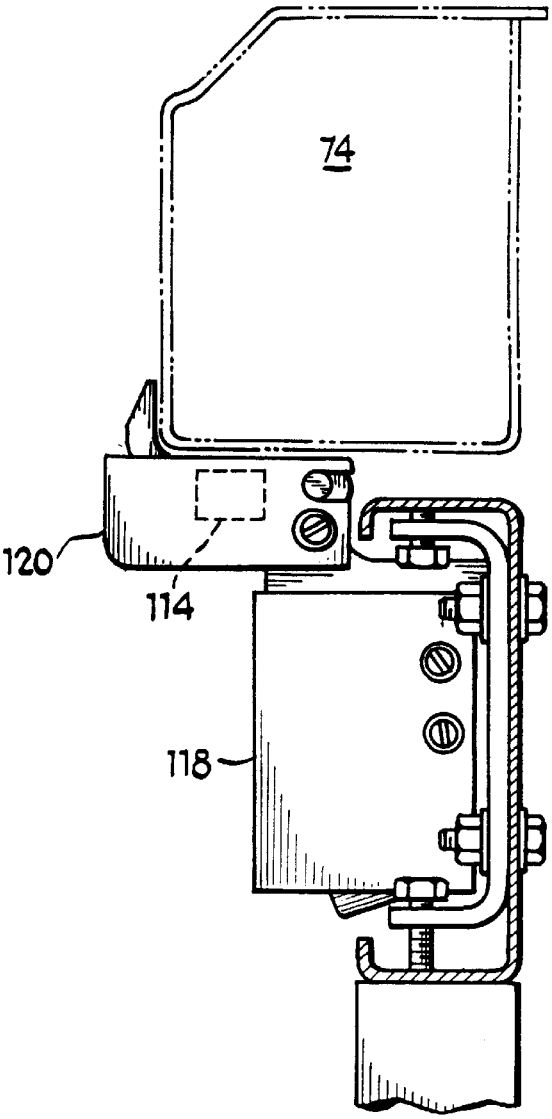
FIG. 7 is a side view taken along the lines 4—4 in FIG. 2 with a solenoid cover and latch guard for a portion of the security system, in accordance with the present invention.

As best shown in FIG. 7, the housing 64 can include a solenoid cover 118 and latch guard 120 for protecting the latching device (and linkage) from load shifts.

In use, the electro-mechanical actuator 56 is in a form of a solenoid, and can be suitably actuated, to convert electrical energy to magnetic energy, which in turn can be converted to a mechanical energy. Thus, this structure can generate a pulling action to provide the locked position 60 in FIG. 6. Continuing, the plunger 110 continues until it bottoms out internally against a permanent magnet within the actuator 56, thus, positioning the linkage to provide a simulated rigid link. Subsequently, when the actuator 56 is next actuated via the remote transmitter 52, the solenoid by use of the windings, releases the plunger 110 to allow it to move away from the magnet (to move to an extended, solenoid plunger 110 position) extending outwardly, defining an unlocked position as shown in FIG. 5.

As shown in FIGS. 5 and 6, the latching device includes an L-shaped latch 122 with a predetermined angle adapted to be coupled with a complementarily configured block 123 connected to a header 74 of a container, to provide a self-engaging connection.

In one embodiment, a port 124 is included in the door 12, to provide access to a electronic key 126 having an external probe means 128, for connection to system 50, to provide one or more of: external power to the system 50; a battery charger; open and close signals to the system 50; interrogate the system 50 and the like.

Referring to FIGS. 10 through 16, an alternate retrofitable or factory installable security system 150 is shown. The security system 150 is particularly adapted for cargo loading doors for domestic containers and trailers and the like. Placement of system 150 may vary from the position (top right) shown in FIG. 1 and the other figures, the placement shown in the figures being a preferred placement to minimize the possibility of breakage during loading and unloading of cargo.

The security system 150 in its simplest form, comprises: a remote transmitter 152 for transmitting a radio signal; a receiver 154 for receiving the radio signal from the remote transmitter 152; an electro-mechanical actuator 156 coupled to the receiver 154 for moving a pin device 166 between a locked position 160 and an unlocked position 162; and a lock assembly 158 for holding the electro-mechanical actuator 156, a pin device 166 and a linkage mechanism 168 coupling the electro-mechanical actuator 156 and the pin device 166 for moving the pin device 166 to and from a locked position 160 to an unlocked position 162.

In one embodiment, the remote transmitter 152 and receiver 154 can each be transceivers, for an improved intelligent communication system. The system 150 can provide for storage, identification, memory and interrogation of the system 150, for example. This feature could provide a history of all door openings, closings and tamperings of the system 150.

This system is configured to be tamper resistant because of it's placement which is preferably internal to a container. In addition, system 150 has been designed in a preferred embodiment to have a low profile to minimize intrusion into the valuable cargo space of the container. In one embodiment, only one pin device 166 is necessary to lock two doors when utilized with a door retainer or the like, providing simplicity of design. As should be understood, other embodiments can include a plurality of pin devices.

In a preferred embodiment, the lock assembly 158 is adapted to being connected to an inside of a cargo loading door, such as positioned at the top right corner, as shown in dashed line as item 50 in FIG. 1. This remote placement is out of the way so as not to interfere with the loading and unloading operation. Thus, this strategic position provides a substantially tamper proof security system, preferably with internal placement of system 150, so as to be visually hidden from an opportunist or thief.

Figure 16:
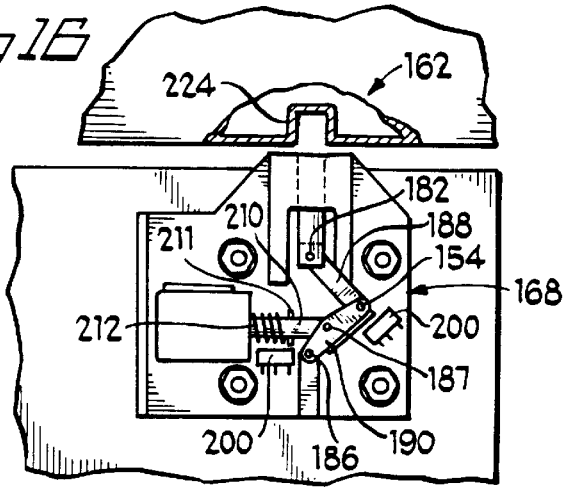
FIG. 16 is a partial inside view of a selected portion of the security system in FIG. 10, without a cover (to show the placement of some of the various components), in accordance with the present invention.

Also in a preferred embodiment, the pin device 166 is particularly adapted to lock and interconnect to a header 174 of a container 10 when the pin device 166 is in the locked position 160 and unlocked 162 from the header 174 when the pin device 166 is retracted, as shown as item 162 in FIG. 16. By utilizing a header of a container to lock the doors, a retrofittable or factory installable system 150 can be installed, thus minimizing the need for cutting, drilling or welding during installation.

The lock assembly is shown with primary connecting devices 176, or fastening means such as bolts and nuts extending through the door and attach a portion of the system 150 to the inside door 14.

Figure 13:
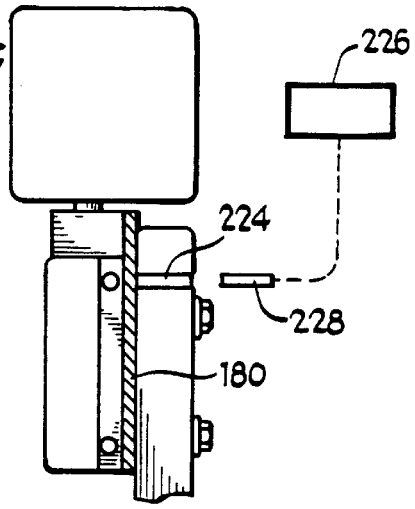
FIG. 13 is a cut away view taken along the lines 13—13 in FIG. 11, of a portion of the security system of FIG. 10, showing the pin structure in a raised position (or a portion of the lock assembly in a locked position), in accordance with the present invention.
Figure 14:
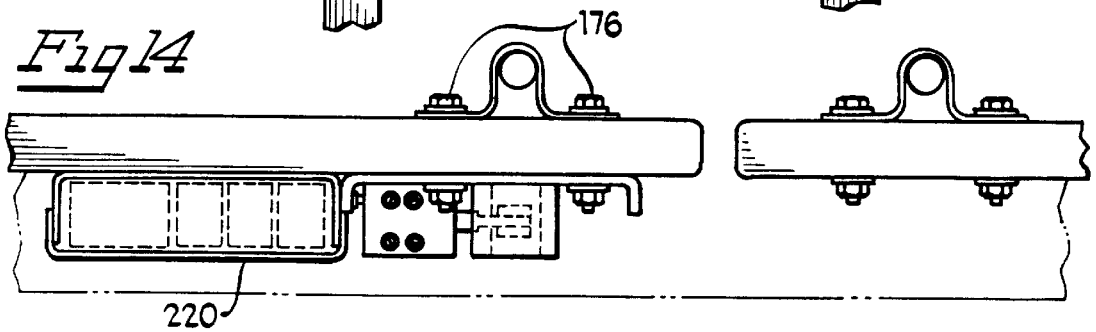
FIGS. 14 and 15 show top views of a portion of the security system in FIGS. 10, without and with a cover, respectively, in accordance with the present invention.
Figure 15:
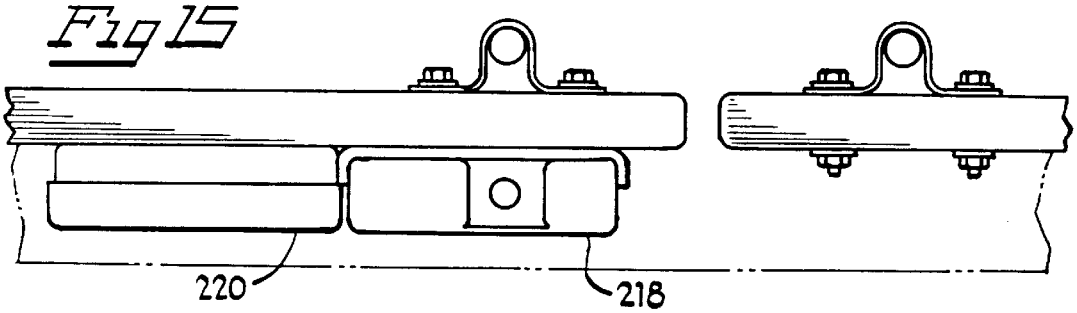

As best shown in FIG. 13, the lock assembly 158 has a back plate 180 adapted to fit and connect to a back, inside door of a container, for ease of installation and adjustment, if necessary. This structure can help in allowing for variations in door and frame geometries.

Figure 10:
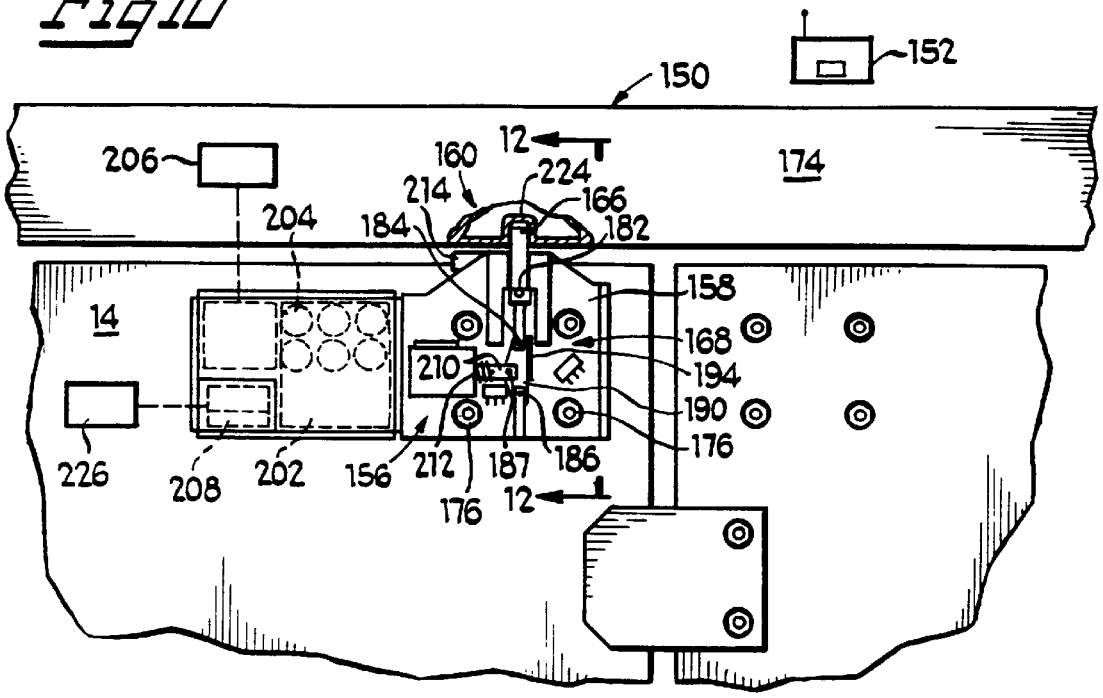
FIG. 10 is an inside view of part of an alternate embodiment of the security system, without a cover (to show the placement of some of the various components), in accordance with the present invention.

As illustrated in FIGS. 10 and 16, the linkage mechanism 168 includes a distal section 188 and a proximal section 190, the distal section 188 is coupled to the pin device 166 and the proximal section 190 is couplable with the electro-mechanical actuator 156, via a fourth pivot pin 188. This structure provides the advantages of a converting minimal linear motion to angular motion required to magnify the linear movement of the pin device 166 from the locked 160 to the unlocked position 162 and vice versa. Advantageously, it also simulates a rigid link thus holding the pin device 166 in its locked position, for improved strength and integrity. Additionally, in the locked position 160, the system 150 is self locking and requires essentially no battery power, thus minimizing battery drain.

In one embodiment, the distal section 188 includes a stop tab 194. The stop tab 194 properly aligns the linkage mechanism 168 beyond center with respect to the proximal section 190 to simulate a rigid link securing the pin device 166 in it's locked position 160, in FIGS. 10 and 16.

The proximal and distal sections 190 and 188 are couplable with a middle pivot pin 184. The top pivot pin 182 allows rotation and transfer of motion through the distal section 188 to the pin device 166.

As shown in FIGS. 10 and 16, a bottom stationary pivot pin 186 pivotably connects the proximal section 190 to the lock assembly 158 back plate 180. The bottom stationary pivot pin 186 is significant in the conversion of linear to angular motion, and contributing to maintaining a simulated rigid link. This structure allows a minimal amount of displacement from the electro-mechanical actuator 156 to move and rotate the linkage mechanism 168, which in turn moves the pin device 166 to and from the locked and unlocked positions. During an attempted break-in (prying, striking, etc.), the linkage mechanism 168 is configured to maintain its integrity, by for example, transfering forces away from the solenoid 156.

As shown in FIG. 16, the back plate 180 can include one or more sensors 200 for sensing whether the pin device 166, is in the locked or unlocked position 160 or 162. In the event that the pin device 166 is not in an unlocked position after a given command from the remote transmitter 152, the sensor(s) 200 can provide a signal that will allow re-execution automatically after a predetermined time, for example. In addition, this structure can provide feedback in order to give positioning data as to internal location of the pin device 166.

In one embodiment, the security system 150 includes an electronic control 202 or interface structure, coupled to the receiver 154 and the electro-mechanical actuator 156. This structure interprets the transmitted information to suitably execute an open or close command, for example. Advantageously, this structure can receive information from the remote transmitter 152 without the necessity of an external power source other than the batteries or power supplies 208 shown in the figures. Also, this structure 202, like most of the other components of the security system 150, has a narrow width or profile so as to minimally intrude into the valuable cargo space of a container.

As shown in FIG. 10, the security system 150 further includes an electronic control or interface structure 202 coupled to the receiver 154 and the electro-mechanical actuator 156, capacitor(s) 204, an antenna 206 and a power supply 208. The capacitors 204 suitably build-up and store energy to rapidly release an electrical charge, to actuate the electro-mechanical actuator 156, to appropriately move a plunger 210. This provides an efficient use of the energy supplied by the power supply 208, preferably in the form of batteries. The antenna can vary widely depending on the application, and can be of a conventional or patch type, for example. In a preferred embodiment, the antenna is placed internal to a container to keep it hidden and minimize the possibility of damage, and is appropriately coupled to the system 150, for reception of a signal. In another embodiment, the antenna could be external, if desired.

In a preferred embodiment, a sensor, such as but not limited to, a proximity sensor 214 can be utilized to allow the pin device 166 to be actuated only when a door 14 is in proximity to a metallic material, such as a header 174. Thus, this feature can help to minimize damage to the pin device 166, when closing the door with the pin device 166 in a locked or extended position 162. The sensor 214 is suitably connected to the other components of the security system 150, for example 154 and 156 and is preferably physically connected to and in proximity of the pin device 166, for accurate sensing.

In FIG. 16, the electro-mechanical actuator 156 includes a plunger 210, a snap ring 211 and a spring 212. The spring 212 provides an outward force to bias the plunger 210 to an extended position when the plunger 210 is released.

Figure 11:
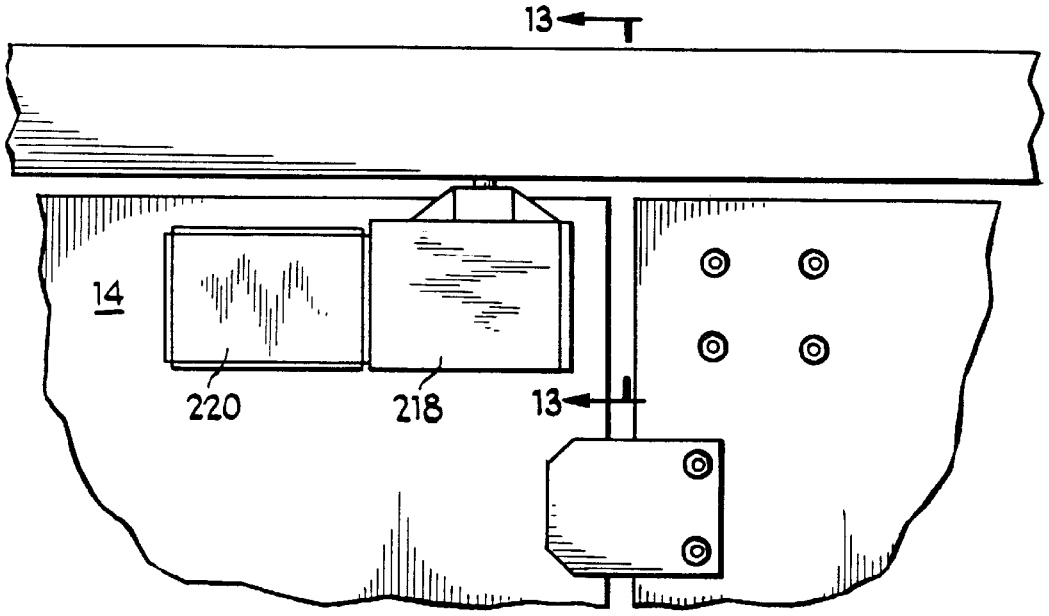
FIG. 11 is an inside view of part of the security system in FIG. 10, with a cover which protects many of the components, in accordance with the present invention.
Figure 12:
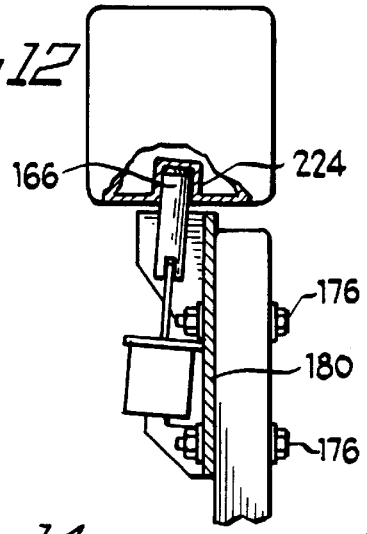
FIG. 12 is a side view taken along the lines 12—12 in FIG. 10 without a cover, of a portion of the security system of FIG. 10, in accordance with the present invention.

As best shown in FIG. 11, the lock assembly 158 can include a solenoid cover 218 and electronics cover 220 for protecting the system 150 components and linkage mechanism 168 from load shifts.

In use, the electro-mechanical actuator 156 is in a form of a solenoid, and can be suitably actuated, to convert electrical energy to magnetic energy, which in turn is convertable to a mechanical energy. Thus, this structure can generate a pulling action to provide the locked position 160 in FIG. 10. Continuing, the plunger 210 continues until it bottoms out internally against a permanent magnet within the actuator 156, thus, positioning the linkage to provide a simulated rigid link. Subsequently, when the actuator 156 is next actuated via the remote transmitter 152, the solenoid by use of the windings, releases the plunger 210 to allow it to move away from the magnet (to move to an extended, solenoid plunger 210 position) extending outwardly, defining an unlocked position as shown in FIG. 10 (right side).

As shown in FIG. 13, the pin device 166 can preferrably be in the form of a dead bolt at a predetermined angle with respect to a vertical axis, and is adapted to be coupled with a complementarily configured recepticle 224 of the header 174 of a container, to provide a self-engaging connection. In one embodiment, a port 224 is included in the door 12, to provide access to a electronic key 226 having an external probe means 228, for connection to system 150, to provide one or more of: external power to the system 150; a battery charger; open and close signals to the system 150; interrogate the system 150 and the like.

Thus, in one embodiment, a security system 150 for cargo loading doors is disclosed. The system can include: at least one of a remote transmitter 152 and electronic key 226 for transmitting a signal; a receiver 154 for receiving the signal from at least one of the remote transmitter 152 and the electronic key 226; an electro-mechanical actuator 156 coupled to the receiver 154 for moving a pin structure 166 between a locked position 160 and an unlocked position 162; and a lock assembly 158 adapted to hold the electro-mechanical actuator 156, and a linkage mechanism 168 coupling the electro-mechanical actuator 156 and the pin structure 166, for moving the pin structure 166 to and from the locked position to the unlocked position.

Various embodiments of a universal adapter for a security system are shown in FIGS. 17 through 29. In its simplest form, the adapter 300 can include: a back plate 302 having a left portion 304 and a right portion 306; and wing sections (also referred to as positioning adapter plates) 308 and 310 extending substantially outwardly from the left and right portions 304 and 306 of the back plate 302, the wing sections having an adjustment structure 312, adapted to adjustably receive a lock assembly 320 of a security system in a first position 322 proximate to the back plate 302 and a second position 324 away from the back plate 302, or in an alternate embodiment, a clamping structure for holding a locking structure with respect to an inside of a cargo loading door.

Figure 17:
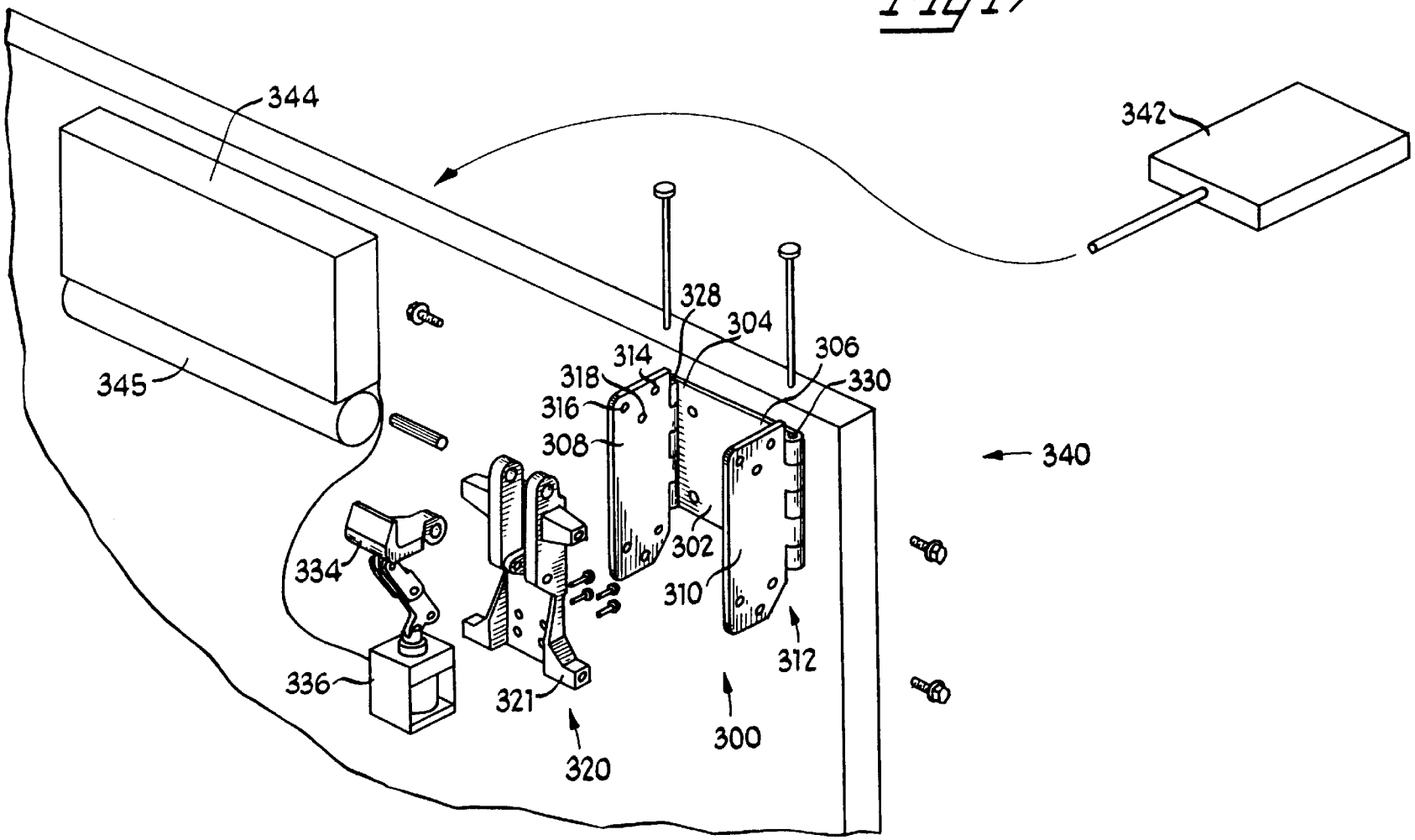
FIG. 17 is an isometric view of an embodiment of the security system, with an universal adapter (to show the placement of some of the various components) and a remote transmitter, in accordance with the present invention.

As illustrated in FIG. 17, in a preferred embodiment, the positioning adapter plates 308 and 310 have at least a first pair of vertically spaced ports 314 spaced in proximity to the back plate 302 and a second pair of vertically spaced ports 316 spaced away from the back plate 302, adapted to receive a lock assembly 320 of a security system in at least one of a first position 322 corresponding to being couplable with the first pair of ports 314 and a second position 324 corresponding to being couplable with the second pair of ports 316. The adapter provides a simple and cost effective design and configuration, to adjustably connect a locking structure with respect to a cargo loading door.

As shown in FIG. 17, the positioning adapter plates 308 and 310 can have a third pair of ports 318 or means for providing a third position 326 for receiveably coupling a lock assembly 320 of a security system with a cargo loading door, for example.

Figure 30:
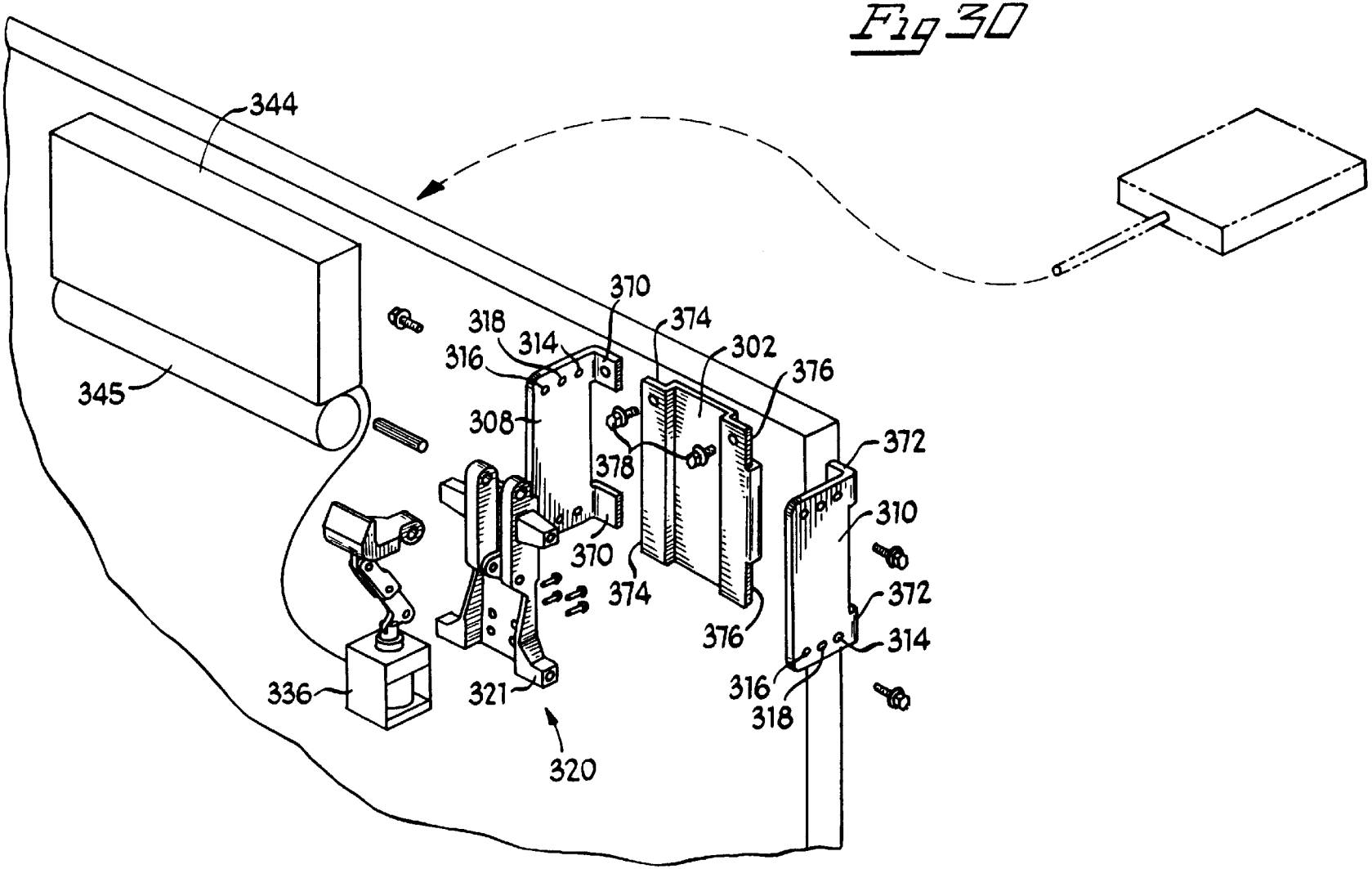
FIG. 30 is an isometric view of an alternate embodiment of the security system, with an universal adapter (to show the placement of some of the various components) and a remote transmitter, in accordance with the present invention.

In an alternate embodiment, slidably attachable positioning adapter plates 308 and 310, are shown in FIG. 30. More specifically, the positioning adapter plates 308 and 310 include inwardly extending flanges 370 and 372 adapted and complementarily configured to be received in receptacles 374 and 376, respectively, for simplified assembly, repair and installation, for example. Locking means, such as bolts 378 and the like securely couple the positioning adapter plates 308 and 310 with the back plate 302. Although shown in the drawings, the bottom flanges 370 and 372 and respective receptacles 374 and 376 are optional, in one embodiment.

Figure 18:
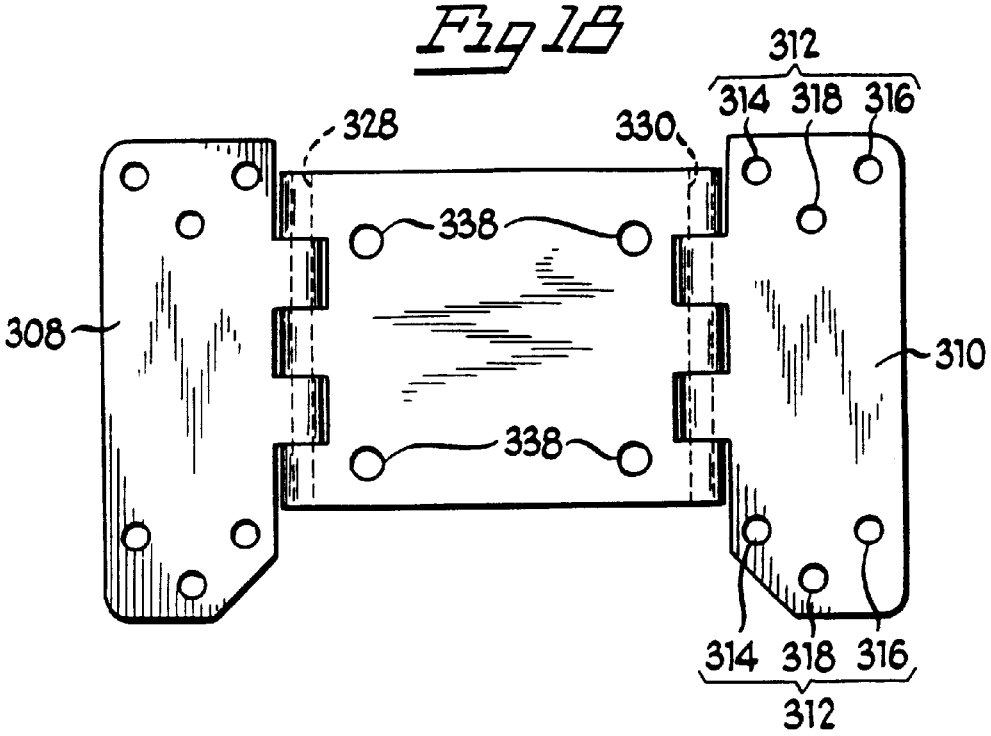
FIG. 18 is an elevated front view of the universal adapter in FIG. 17, in an open position, in accordance with the present invention.
Figure 19:
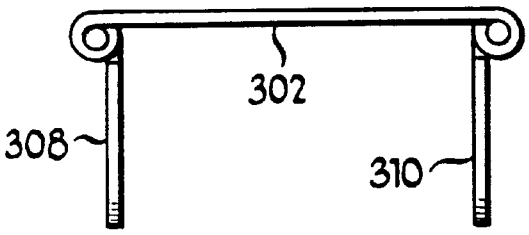
FIG. 19 is a top view of the universal adapter of FIG. 17, in a closed position, in accordance with the present invention.
Figure 20:
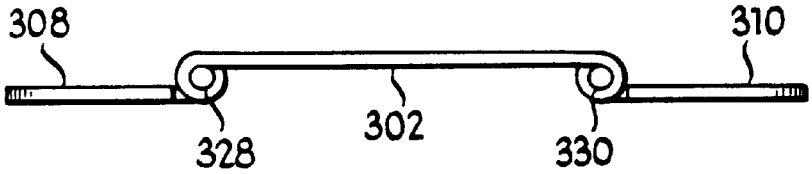
FIG. 20 is a top view of the universal adapter of FIG. 18, in an open position, in accordance with the present invention.
Figures 21, 22, 23, 24:
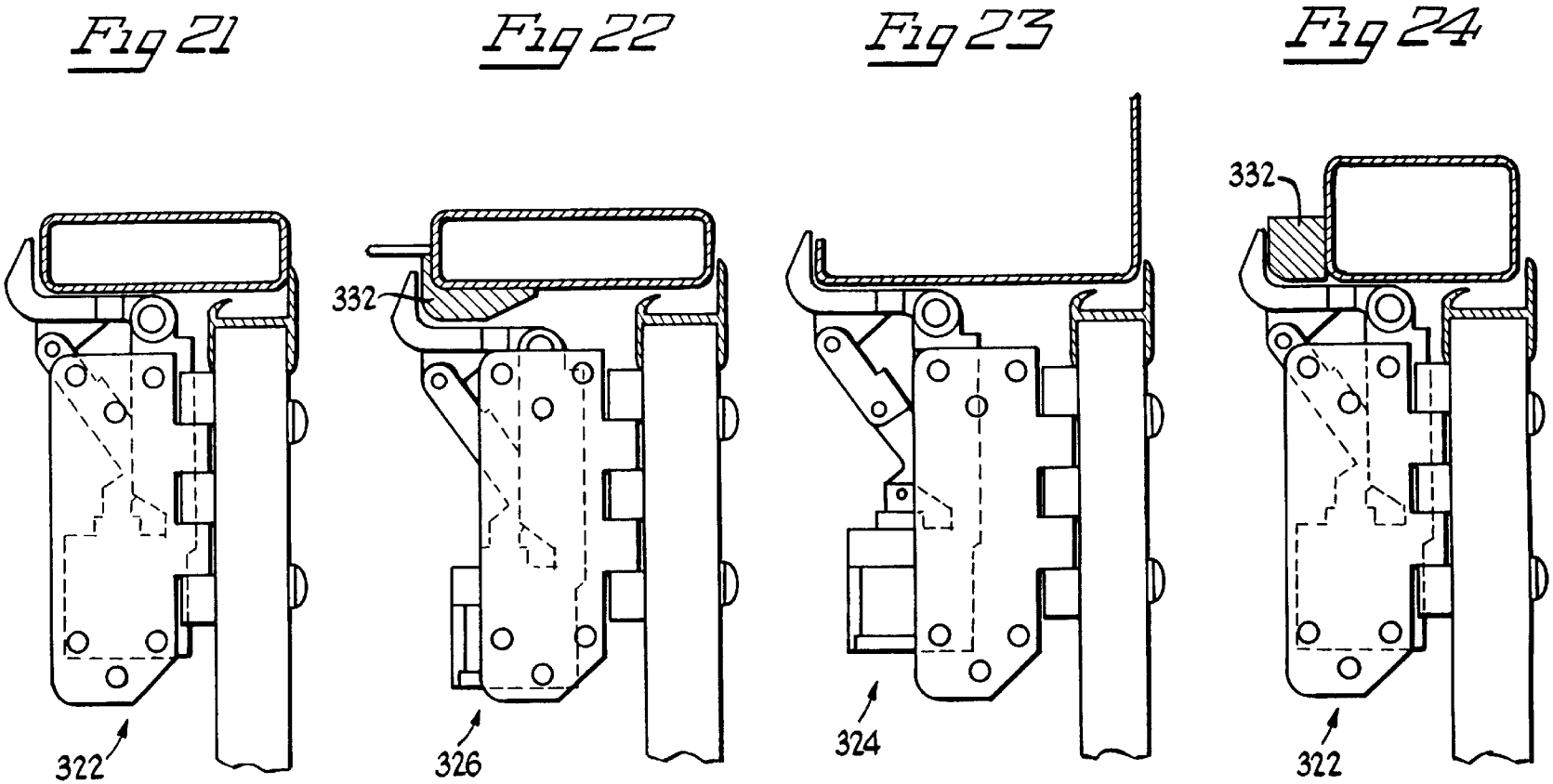
FIG. 21 is a partial view of the security system showing a side view of the universal adapter with a lock assembly with a latching device in a locked position, in accordance with the present invention.
FIG. 22 is a partial view of the security system showing a side view of the universal adapter with a lock assembly having a latching device in a locked position, the latching device is shown contacting a contour adapter, the lock assembly is shown connected to the adapter in a position proximate to a back plate of the adapter, the lock assembly is shown connected to the adapter in an intermediate position, in accordance with the present invention.
FIG. 23 is a partial view of the security system showing a side view of the universal adapter with a lock assembly with a latching device in a locked position, the lock assembly is shown connected to the adapter in a position away from a back plate of the adapter, in accordance with the present invention.
FIG. 24 is a partial view of the security system showing a side view of the universal adapter with a lock assembly having a latching device in a locked position, the latching device is shown contacting a contour adapter, the lock assembly is shown connected to the adapter in a position proximate to a back plate of the adapter, in accordance with the present invention.

Referring to FIGS. 18–20, the positioning adapter plates 308 and 310 can be hingably, slidably or fixably coupled to the back plate 302. In one embodiment, both positioning adapter plates 308 and 310 are hingably coupled via hinges 328 and 330, to the back plate 302, and the positioning adapter plates are substantially mirror images of each other. This construction provides a secure and adjustable connection and anchor for the lock assembly 320 with respect to a door. The hinge structure provides a simple structure for removing the pins 328 and 330, or removal by removing the bolts shown in the figures, when lock assembly is removed from the door. The wing sections 308 and 310 can be folded in a manner flush with the door (when the lock is not in use), thus being out of the way for loading and unloading. In an alternate embodiment, vertical positioning adapter plates are slide mountably coupled to the back plate, for ease of instalation.

In more detail, the positioning adapter plates 308 and 310 are adapted to at least partially receive a lock assembly 320 with a structure such as a pin or latch for example, for locking and unlocking cargo doors, as shown in FIGS. 21–24.

Thus, at least one of the back plate 302 and positioning adapter plates 308 and 310 is couplable with cargo doors of a trailer, domestic or ISO container, preferably trailer or domestic containers, since they are most adaptable and compatable with the adapter 300, as detailed herein. As should be understood by those skilled in the art, the instant invention can be used with structure other than the doors detailed herein, in connection with providing a security system and a secure locking structure.

Referring to FIGS. 21–24, the adapter can further include a contour adapter 322 being complimentarily configured to interconnect with at least part of a latch structure of a lock assembly 320, defining a self-locking mechanism. As shown in the figures, the positioning adapter plates 308 and 310 are adapted to at least partially receive a lock assembly 320 with a latch structure 334 for locking and unlocking cargo doors with an electro-mechanical actuator 336, preferably a solenoid. The solenoid is operable to move the latch 334 or pin (dead bolt structure) to and from a locked position to an unlocked position (as shown in FIGS. 25 and 26).

In one embodiment, a security system 340 with a universal adapter 300 is disclosed, such as shown in FIG. 17. It can include: a remote transmitter 342 for transmitting a signal; a receiver 344 for receiving the signal from the remote transmitter; an electro-mechanical actuator 336 coupled to the receiver 344 for moving a locking structure between a locked position and an unlocked position; the locking structure 320 adapted to receive the electro-mechanical actuator 336, and the electro-mechanical actuator 336 is shown couplable by a linkage mechanism for moving the locking structure to and from the locked position to the unlocked position; and an adapter 300 (in FIG. 17 for trailer applications) or mounting bracket 368 preferably with adapter 350, for ISO container applications (in FIGS. 25–29), for coupling the locking structure with a door, preferably a cargo door, as detailed herein.

In one embodiment, the lock assembly 320 is adapted to being connected to an inside of a door, such as a cargo loading door with the adapter 300 or preferably a mounting bracket 368. The locking structure 320 and mounting bracket 368 are adapted to being connected with a header of an ISO container, domestic container or semi-trailer, defining a locked position in FIG. 25, and disconnected from the header when the locking structure is in the unlocked position in FIG. 26.

For improved security, the lock assembly 320 can include at least one or more connecting devices 346, such as four bolts, attached in and through an inside cargo loading door, as shown in FIG. 25. In addition, positioners 348, such as positioner bolts, touch and contact an inside cargo loading door, for improved positioning, to insure a secure coupling.

As detailed herein, the system 340 can include an electronic control, operatively coupled to the receiver 344, which can include a mail pouch 345, as shown in FIG. 17, and the electro-mechanical actuator 336, including a trigger circuit, capacitors and power semiconductors, for wireless actuation of the locking structure. A thermal insulative quilt can be used in connection with the receiver 344 and other structure, as shown in FIGS. 31–34, for thermal and physical protection of the batteries and associated components, from exposure to the elements (rain, snow, dust, dirt, etc.) and severe temperature variations.

In one embodiment, the adapter 300 can comprise: a back plate 302 having a left portion and a right portion; and positioning adapter plates 308 and 310 extending substantially outwardly from the left and right portions of the back plate 302, the positioning adapter plates 308 and 310 having means for adjustably receiving a lock assembly of a security system in at least one of a first position proximate to the back plate and a second position away from the back plate, as illustrated in FIGS. 21–24.

In an alternative embodiment, as shown in FIGS. 25–29, the mounting bracket 368 with adapter 350, comprises clamping device 351 for substantially securing the locking structure 352 with respect to an inside of a cargo loading door, preferably an ISO container door. The adapter 350 can be in the form of a clamping structure for substantially securing a locking structure with respect to an inside of a cargo loading door. The clamping structure 351 can include a plurality of substantially mirror imaged grip plates 354 and 356, each including a proximal section 358 and distal section 360 with teeth structures 362, for securely gripping and clamping onto a surface, the proximal section 358 is adjustably couplable by various means, such as with a lip 366 and a bolt 364, for facilitating, secure coupling of a lock structure with respect to a door. In one embodiment, the mounting bracket 368 and adapter 350 are an integral (substantially single) structure, for simplicity of construction and minimal parts.

In this embodiment, the locking structure has it's own integrated back plate 368. The locking structure in this embodiment is particularly configured and designed to mate and be coupled to a door of an ISO container. As shown in FIGS. 25 and 26, the clamping device 351 assures that a top portion of the locking structure 352 and integrated mounting bracket 368 is substantially held in place. Likewise, the bottom portion is held snugly in place with the positioner bolt 348. Thus, this structure is configured to securely hold a locking structure 352 in place with respect to a door, without the necessity of drilling and placing bolts, etc. through a door. Optionally, the mounting bracket 368 can also be bolted to the door or otherwise suitably connected to a door.

Figure 31:
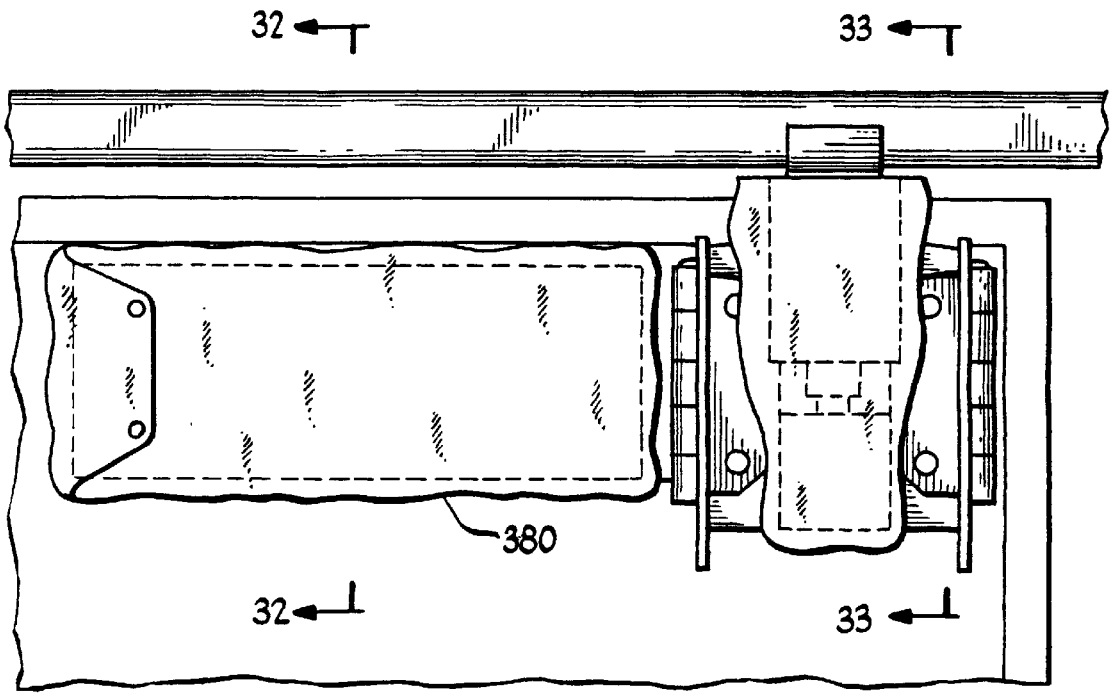
FIG. 31 is an elevated front view of the universal adapter in FIG. 17, with an insulative protection layer, in accordance with the present invention.
Figure 32:
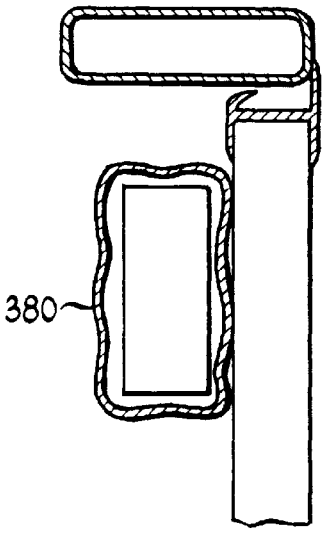
FIG. 32 is a side sectional view along lines 32—32 of the universal adapter of FIG. 30, in accordance with the present invention.
Figure 33:
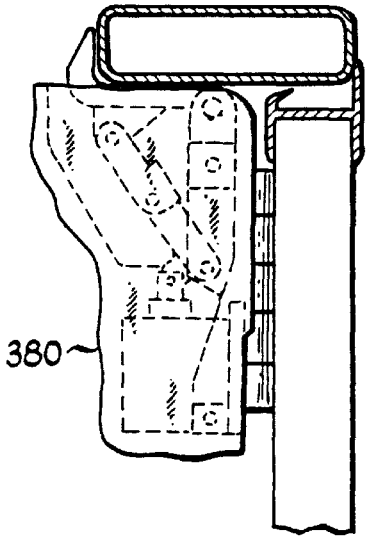
FIG. 33 is a side sectional view along lines 33—33 of the universal adapter of FIG. 30, in accordance with the present invention.

In FIGS. 31–33, a preferred insulating quilt layer 380 is shown substantially enclosing the components of the invention, for thermal and physical protection.

The present invention is described in terms of a preferred implementation directed to a solenoid driver circuit of a solenoid locking device adapted for use with a shipping container or similar cargo delivery container. It will be readily appreciated that its teachings has broad applications beyond those set forth in the preferred embodiment. For example, the present invention may be applied to solenoid locking devices utilized in building, constuction, storage, automotive and other applications, and particularly transportation-related applications.

Figure 34:
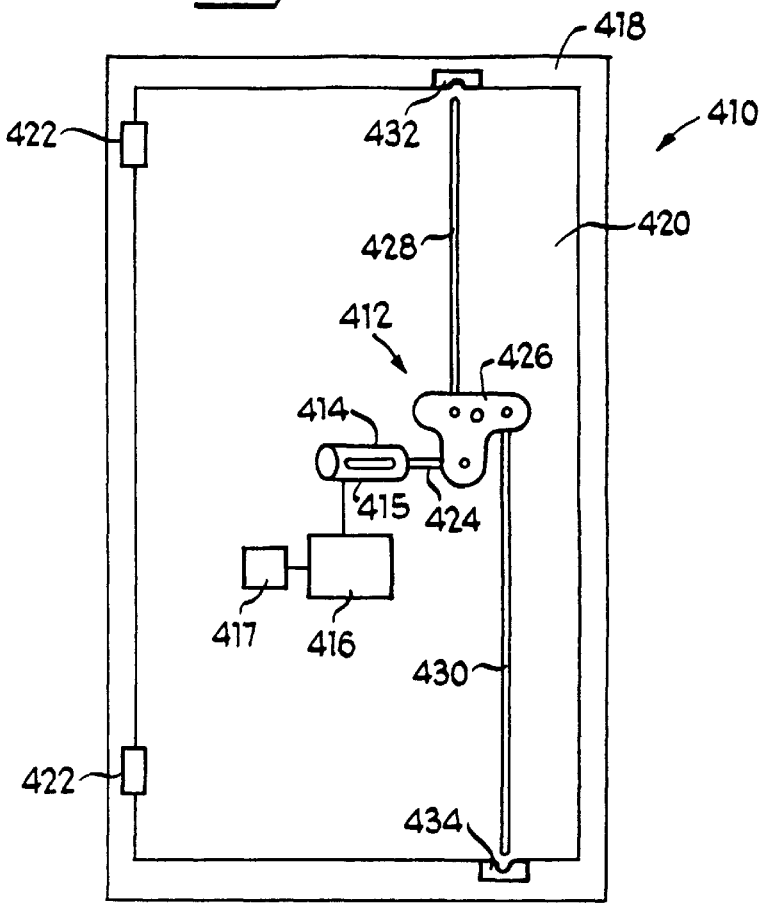
FIG. 34 is a partial view of a container fitted with a solenoid locking device.

FIG. 34 illustrates a shipping container 410 adapted with a locking mechanism 412 including solenoid 414 and solenoid driver unit 416. Shipping container 410 includes container housing 418 enclosed by door 420 secured to housing 418 by hinges 422. Locking mechanism 412 includes a lock actuating member 424 coupled for actuation by solenoid 414 and to a pivot member 426. Selective actuation of solenoid 414 causes linear movement in a first direction of actuating member 424 and rotational movement of pivot 426 for driving lock members 428 and 430 into mating members 432 and 434, respectively, for locking the door 420 of container 410. Reversing the energization of solenoid 414 retracts actuating member 424 for retracting lock members 428 and 430 from mating members 432 and 434 for unlocking door 420.

Figure 35:
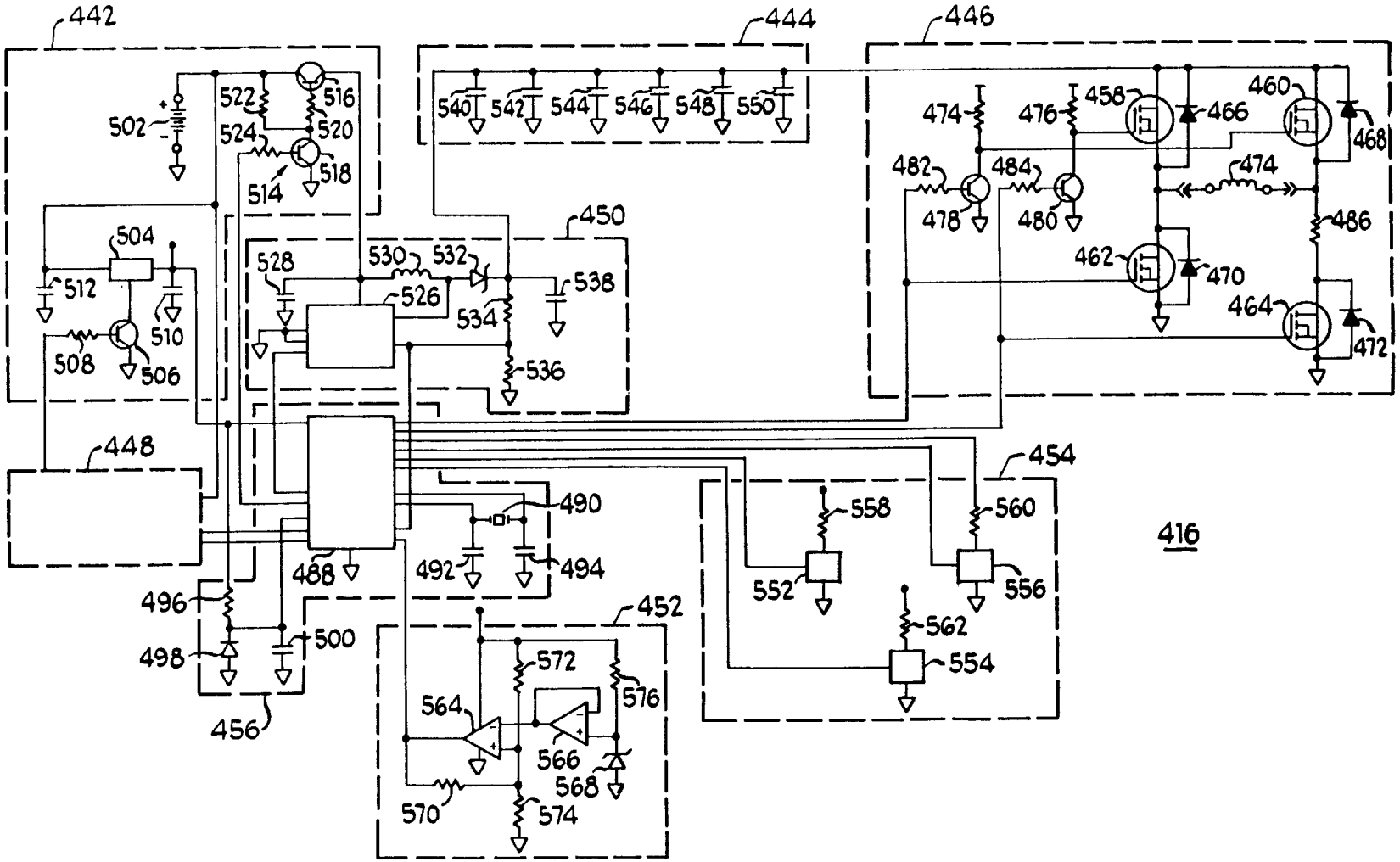
FIG. 35 is a schematic illustration of a solenoid driver unit for use with the solenoid locking device shown in FIG. 34 or any of the previous locking devices in the figures, and in accordance with a preferred embodiment of the present invention.
Figure 37:
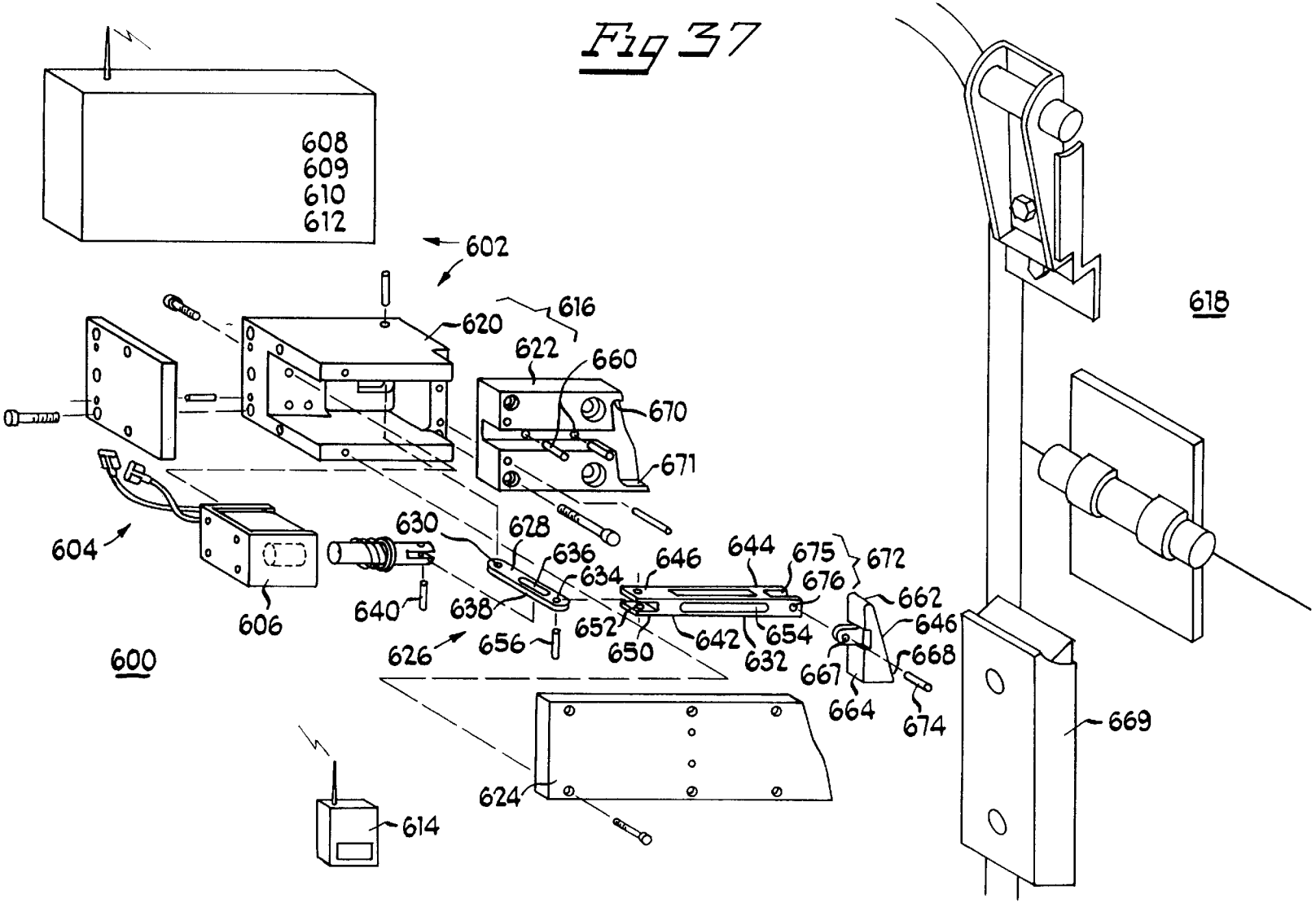
FIG. 37 is an exploded view of a security system for a roll down door in accordance with an embodiment of the present invention.
Figure 38:
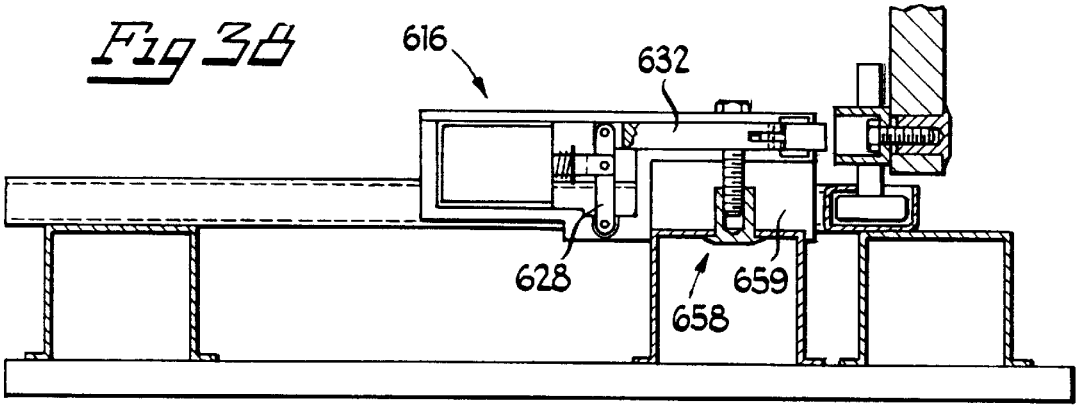
FIG. 38 is a simplified top plan view of an embodiment of the security system for a roll down door, in accordance with the present invention.
Figure 39:
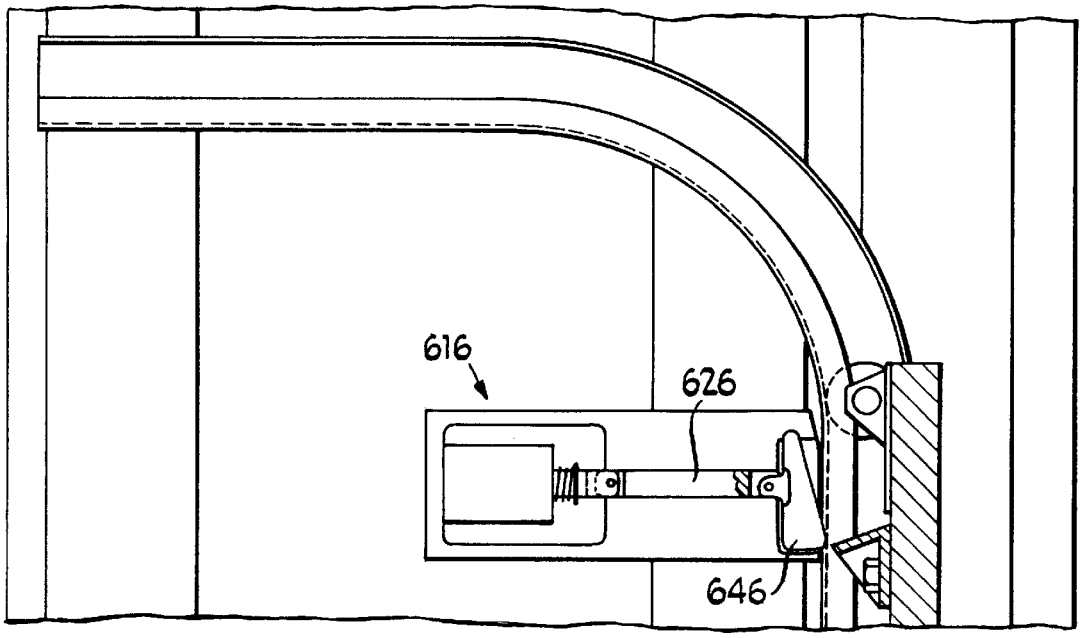
FIG. 39 is a simplified side plan view of an embodiment of the security system for a roll down door with a direct drive linkage and with an adjustment mechanism, in accordance with the present invention.
Figure 40:
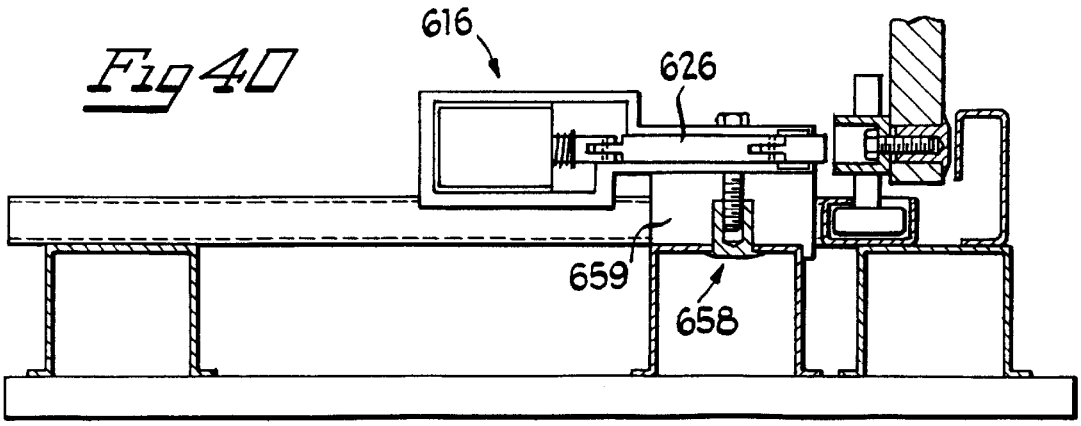
FIG. 40 is a simplified bottom plan view of an embodiment of the security system for a roll down door with a direct drive linkage and with an adjustment mechanism, in accordance with the present invention.

Referring now to FIG. 35, solenoid driver unit 416 is illustrated in more detail and includes power supply section 442, energy storage section 44, solenoid driver section 446, input interface section 448, boost section 450, temperature compensation section 452, sensor interface section 454 and processor section 456. In brief overview of the operation of unit 416, under control of processor section 456, power supply section 442 provides a supply of electrical energy which is stored in energy storage section 444 via boost section 450. Boost section 450 increases the output voltage of power supply section 442 allowing circuit 444 to utilize a lower voltage power source. Circuit 444 provides a higher level of power and thus a more rapid response than can be realized by batteries alone.

Locking mechanism 412 is operated in response to user provided input signals at interface section 448. The input signal is processed and a lock or unlock signal is output from input interface section to processor section 456. In response to the lock or unlock signal, processor 456 provides signals to solenoid driver section 446 for energizing solenoid 414 to either drive actuating member 424 to the lock or unlock position, respectively.

This circuit can provide an efficient, high power energy source which rapidly accuates and moves the solenoid. The movement and magnetic latching properties, allow the lock mechanism to positively latch into a secure position. This position provides a substantial locking force, which is not easily dislodged.

The use of this circuit with a solenoid, provides an energy-efficient means of using battery power to operate a locking device. A solenoid is a preferred device, however other similar devices could be used with this circuit, such as but not limited to, lighting devices, motors, actuators and the like.

With continued reference to FIG. 35, solenoid 414 can vary widely. In a preferred embodiment, a single-coil magnetically-latching solenoid may be used. Four metal-oxide field effect transistors (MOSFETs) 458–464 are preferably used in an H-bridge configuration. It will be readily appreciated that other type transistors and arrangements may be employed without departing from the scope of the present invention. Each of the transistors are suitably protected against voltage spikes via diodes 466–472. Transistors 458 and 460 are p-channel devices which are turned on by the application of a "low" signal at their gate inputs. The gates of each of transistors 458 and 460 are normally held high by voltage V+ and pull up resistors 466–468, respectively. Switching transistors 478 and 480 are provided which when turned on via application of a high signal to their base through resistors 482 and 484, respectively, pull the gates of transistors 458 and 460 low for turning transistors 458 and 460 on. Transistors 478 and 480 may be any suitable type switching transistor with resistors 482 and 484 chosen to be of an appropriate value as is known in the art. Transistors 462 and 464 are n-channel devices which are turned on by application of a "high" signal at their gates. Transistor 458, via switching transistor 478 and transistor 462 are coupled to receive a lock signal from processor section 456, while transistor 460, via switching transistor 480 and transistor 464 are coupled to processor section 456 to receive an unlock signal.

Processor section 456 includes a microcontroller 488, a suitable oscillator 490 and isolation elements: capacitors 492 and 494, resistor 496, diode 498 and capacitor 500. The microcontroller 488 can be an eight or sixteen bit device available from various sources, and in a preferred embodiment is a PIC 16C65 8-bit microcontroller available from Microchip Technology, Inc., and is coupled to receive a regulated voltage from power supply section 442, signal inputs from input interface section 448 and sensory inputs from temperature compensation section 452 and sensor interface section 454. Microcontroller is further coupled to provide the lock and unlock signals to solenoid drive section 46 and provide a shutdown signal (SHDN) to boost section 450 in response to a feedback signal (F/B) from boost section 450.

Input interface section 448 provides an interface to the user for locking and unlocking mechanism 412. It is contemplated to use any one or more of a radio-frequency device, electro-mechanical switches, proximity sensors, photoelectric sensors, digital signal inputs and pushbuttons or other manual devices for receiving a user input signal. Input interface section 448 is coupled to receive electrical power from power supply section 442 and to provide a system enable signal to power supply section 442. Input interface section is further coupled to provide either a lock or unlock signal to processor section 498 in response to the user input signal. Preferably a digital radio-frequency (RF) signal is utilized to provide remote actuation and to prevent inadvertent locking or unlocking.

In a preferred implementation, solenoid driver unit 416 may be adapted to include a transceiver 417. Transceiver 417 would receive from microcontroller 88 information relating to status of lock mechanism 412, battery 502, sensors 552–556 and other parameters which may be communicated to a remote location. In this manner the status of many containers may be verified from a central location without having to manually check each such container. In addition, the transceiver may be adapted to provide a signal in the event lock mechanism 412 has been tampered with. Transceiver 417 would be adapted to communicate under a suitable data communication protocol, but preferably a digital RF communication protocol.

Power supply section 442 preferably includes a 3 cell, 9 volt lithium or lithium-ion battery 502, however, it will be appreciated that other battery types may be used without departing from the fair scope of the present invention. Power supply section further includes a voltage regulator 104 which is coupled to receive the enable signal from input interface section 442 via switching transistor 506 and resistor 508. Voltage regulator 504 is further provided with isolation capacitors 510 and 512. Voltage regulator 504 provides a regulated 5.0 volt power supply to microcontroller 488. Power supply section further includes battery isolation circuit having transistors 516 and 518 and resistors 520–524. Circuit 514 prevents battery power from prematurely charging the boost section 450. Processor section 456 sends a logic high signal to the base of transistor 518 via resistor 524 which grounds the base of transistor 116 via resistors 520 and 522 which conducts power to boost section 450.

Boost section 450 provides for stepping up the voltage output of power supply 442 for providing and increased operating voltage for solenoid driver unit 416. The higher operating voltage produces more current in solenoid 414 providing more rapid response or allowing use of larger solenoids. Boost section 450 includes a dc/dc power converter 526 which preferably provides between a 415 and 20 volts dc output. The shutdown pin (SHDN) of converter 526 is normally held high by processor section 456 inhibiting operation of converter 526. When processor section 526 pulls SHDN low, converter 526 begins pulsing inductor 530 causing a voltage buildup at the cathode of shottkey diode rectifier 532. The voltage output of shottkey diode 532 is coupled to energy storage section 444. As the charge voltage to energy storage section 442 increases, a voltage is developed across resistors 534 and 536. The voltage between resistors 534 and 536 is feed to a comparator input of microcontroller 488 and when it exceeds a threshold, preferably about 1.24 volts, processor section 456 shuts down boost section 450 via the SHDN pin.

Energy storage section 444 provides a means for storing the increased voltage output of boost section 450. Preferably, energy storage section 444 includes a plurality of capacitors, six shown as 540–550, which are coupled to boost section 450 and to solenoid driver section 446. Once charged, capacitors 540–550 through rapid discharge into solenoid 414 provide the drive potential for operating locking mechanism 412. Moreover, a relatively high-amperage solenoid may be energized with only a battery supply. It will be appreciated that more or less capacitors or other forms of rapid discharge electrical energy storage devices may be used without departing from the spirit of the invention.

To provide means for compensating for environmental temperature fluctuations, temperature compensation section 452 is coupled to processor section 456. Temperature compensation section 452 includes a temperature sensor 568, preferably a a LM 134, available from National Semiconductor. Temperature sensor 168 provides a voltage of approximately about 10 mV/K° (10 millivolts per degree Kelvin). The voltage is buffered by a first half of dual micropower operational amplifier 566. The buffered signal is used as an input to a second half of operational amplifier 564 which is configured as a comparator. Resistors 572 and 574 provide a voltage divider circuit to establish a setpoint voltage for the comparator. When the temperature (and resulting buffered voltage) decreases, the inverting input on the comparator is at a lower voltage than the non-inverting input set by the voltage divider. The output changes state aided by positive feedback resistor 570 increasing the positive gain and rapid saturation of the output. The output is monitored by microprocessor 488. During periods of extreme temperatures, microcontroller 488 detects these environmental changes and alters the charging time of boost section 450. For example, microcontroller 488 may decrease charge time during warm temperature, increase charge time during low temperature and limit operation during extreme temperatures, to further enhance the environmental performance of solenoid driver unit 416.

To further enhance solenoid drive unit 416 sensor interface section 454 is provided and coupled to processor section 456. Sensor interface section 454 includes locked sensor 552, unlocked sensor 554 and external mechanism sensor 556. Each of sensors 552–554 are suitable proximity sensors which are powered on by microcontroller 488 only when needed. More particularly, microcontroller 488 pulses the switch on by applying a dc voltage to the switch. After a short time delay, microcontroller 488 reads the status of the sensors 552–556. This allows for full logical control and further energy conservation. For example, if the user inputs a lock signal when the lock mechanism is in the lock position, solenoid 414 is not energized thereby conserving energy. In one embodiment, the external mechanism sensor 556 can be an appropriate door position means, for providing the position (open or closed) of the door.

It is contemplated, to provide an alternate external power source which can provide power to the solenoid driver circuit for any reason, such as if battery 502 becomes discharged, for example. An external power connector would be provided (not shown) in power supply section 442, in FIG. 36.

Figure 36:
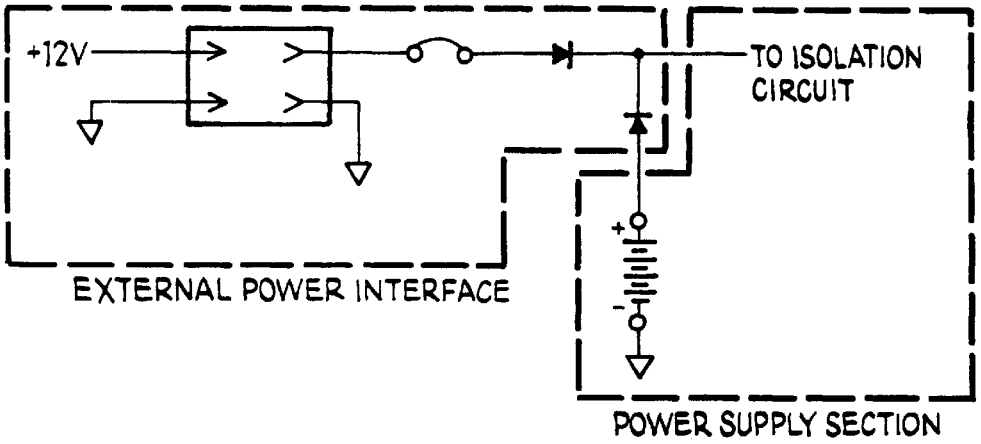
FIG. 36 is a schematic illustration of a solenoid driver unit for use with the solenoid locking device shown in FIG. 35, with an external power interface, in accordance with a preferred embodiment of the present invention.

In a preferred embodiment, as shown in FIG. 36, a 12-volt DC power external power source is introduced to the circuit via connector J1. A circuit breaker (CB1) serves to protect the system from short circuit conditions. Diodes D6 and D7 are used to provide circuit isolation. Diode D6 substantially prevents battery voltage from leaking into the external power source, while diode D7 substantially prevents external voltage from charging the batteries. As would be known in the art, other potential circuits could be used to sufficiently isolate the batteries from the external power source and would permit appropriately conditioned power to flow into solenoid drive unit 416. Moreover, in one embodiment, the external power source may be adapted to provide charging of battery 502.

In operation, a signal is received at input interface section 448, an enable signal is provided to power supply section 442 turning on transistor 506 enabling voltage regulator 504 and powering-up microcontroller 488. Microcontroller receives either a lock or unlock signal from user interface 448 and provides a signal to power supply section 442 to turn on transistor 516 for coupling battery 502 to boost section 450. With boost section 450 enabled, energy storage section 444 is charged. When energy storage section 444 is fully charged, as indicated by a high signal on SHDN and the outputs from temperature compensation section 452 and sensor interface section 454 are acceptable, microcontroller outputs as appropriate sends a lock or unlock signal to solenoid driver section 446. In the event of a locking, the lock, "high", signal is applied to switching transistor 478 and transistor 462 for turning on transistors 460 and 462. Current is allowed to flow from energy storage section 444 through transistors 460 and 462 energizing solenoid 414 for actuating lock mechanism 412 into the lock position. In the event of an unlock signal, the unlock, "high", signal is applied to transistors 480 and 464 for turning on transistors 458 and 464. Current flows from energy storage section 444 through transistors 458 and 464 and resistor 486. Resistor 486 causes a voltage drop which cancels the magnetic latching field of solenoid 414 freeing solenoid 414 and opening lock mechanism 412.

The microprocessor based implementation of the present invention is preferred in that it provides more efficient control of the system adjusting to environmental conditions and preserving battery charge. By energizing microcontroller 488 only upon receipt of a signal at user interface section 448, a sleep mode is provided for conserving energy. Microcontroller 488 is adapted to turn off after a period after receipt of an input signal and until another signal is received. Furthermore, battery charge is not used directly to energize solenoid 414 and a boost section 450 is incorporated to provide stepped up potential for operating solenoid 414. This implementation provides a cost effective and reliable solenoid actuated operating device operating on battery power.

As shown in FIGS. 37–40, a security system (locking device) 600 for a roll down door is shown, comprising: a locking device 602 including: a lock actuation member 604 operatively coupled with a solenoid 606, the solenoid 606 being adapted to move the lock actuation member 604 to either of a locked state and an unlocked state; a solenoid driver circuit 608 coupled to the solenoid for selectively energizing the solenoid 606, the solenoid driver circuit 608 coupled to receive electrical energy from an energy storage circuit 609; a power supply 610 coupled to selectively provide electrical power to either of the solenoid driver circuit 608 and the energy storage circuit 609; an input interface 612 adapted to receive a user signal and to provide an output signal in response thereto; and a controller 614 coupled to the input interface 612, the power supply 610, the energy storage circuit 609 and the solenoid driver circuit 608 to cause selective energization of the solenoid 606 in response to the output signal; and a housing 616 including the solenoid 606 and a substantial portion of the lock actuation member 604. Note that many of the electric components have been previously discussed with respect to the earlier drawings, and are hereby incorporated herein.

The security system is particularly adapted for use with roll down doors 618 and the transportation security industry. Advantageously, the system can provide a narrow profile (substantially free from extending into the valuable cargo space of a container), self contained, portable, and minimal power consumption (long battery life) security system, depending on the application.

The input interface 612 can include at least one of a radio-frequency device, an electro-mechanical switch, a proximity sensor, pressure sensor, a photoelectric sensor and a pushbutton, and preferably radio frequency for cargo security applications. The solenoid driver circuit can comprise a plurality of transistors arranged in an H-bridge configuration and the power supply can include a battery coupled to a voltage boosting circuit, in one embodiment.

In one embodiment, the power supply 616 further comprises at least one of a voltage regulator coupled to the battery and to the controller and a battery isolation circuit coupled between the battery and the voltage boosting circuit and further coupled to the controller, for improved perfomance in security applications.

The controller 614 is enabled upon receipt of the user signal at the input interface, to lock and unlock appropriately.

The housing 616 can include modular sections comprising a proximal section 620 and a distal section 622, with a cover 624, for ease of manufacturing, assembly and replacement of components.

The lock actuation member 604 is operatively coupled with the solenoid 606, through a linkage 626 comprising: a radial member 628 pivotably connected to a proximal section 620 of the housing 616 at a first end 630 and connected to an axial member 632 of the linkage 626 at a second end 634, and the solenoid 606 at a middle section 636 thereof, the middle section 636 having a slot 638 adapted to receive a pivot pin 640 therein, for providing a pivotable connection of the solenoid 606 with the linkage 626; and the axial member 632 having a near end 642 pivotably connected to the first end 630 of the radial member 628 and a far end 644 connected to a latch 646, the near end 642 including a top finger 648 and a bottom finger 650 with a slot 652 therebetween, the second end 634 of the radial member 628 being configured to fit substantially between the top and bottom fingers 648 and 650. Advantageously, this structure contributes to providing a low profile housing, minimal required movement, minimal power drain because of ease of movement, allows for utilization of a low power (lower cost) solenoid, and provides a means of transfering linear movement in different planes.

The radial member 628 can include a slot 638 adapted to receive a pivot pin 656 therein, for providing a substantially slidable and pivotable connection of the solenoid 606 with the linkage 606, and provides an interface between linear and rotating movement, thus also contributing to ease of movement and simplified interaction of the components of the linkage.

The distal section 622 of the housing 616 includes an adjustment mechanism 658 for securely adjusting the housing 616 with respect to a container wall and roll down door 618, for appropriate, adjustable mounting. An adapter 659 is provided to facilitate connection of the housing 616 with a side wall of a container. In one enbodiment, the adapter 659 can be boltable, slidably connected, pinably connected and any other suitable connection means, for ease of installation, portability and for an overall compact structure.

In one embodiment, the distal section 622 has guides 660 for simplifying movement of the axial member 632 therein, and preferably Nylon blocks are utilized for minimal friction and ease of movement, improved servicability and minimal power drain.

The housing 616 can include a back cover (plate) 624, for ease of manufacture, assembly, adaptability, minimal costs, servicability and ease of replacement of components.

The lock actuation member 604 can include a generally triangular latch including: a substantially circular top section 662 defining a cylindrical socket; a middle section 664 having an interior connecting member 667 adapted to being connected to a linkage 626; and an exterior section 668 with a substantially smooth contour. Advantageously, the socket allows for a ball and socket connection, which allows a maximum transfer of force for its size, while maintaining system alignment. Stated another way, the ball and socket connection provides a portable (small) and secure connection of the latch to the housing. The interior connecting member 667 allows the latch 646 to pivot to and from the locked and unlock conditions. The exterior section 668 engages with a catch 669, for a secure engagement in the locked condition. Preferably, a portion of the latch 646 and catch 669 are generally in a complementary configuration, for a secure engagement. Advantageously, when in the locked condition, no power is required to maintain this condition (substantially free of external mechanical or electrical assistance is required to maintain the locked condition).

In one embodiment, the far end 644 of the axial member 632 has a substantially "L-shaped" opening 672 adapted to receive a pivot pin 674 therein, the pivot pin 674 connects the far end 644 with the interior connecting member 667. The L-shaped opening 672 allows movement of the pin 674, and includes a vertical portion 676 for movement of the latch and horizontal portion 678 (when in the locked condition) isolates forces away from the linkage 626 to the distal portion (cylindrical pocket) ball 670 of the housing, during an attempted breakin.

Adjacent and below cylindrical ball 670, is a recepticle 671 adapted to receive a bottom portion of the latch 646, for providing a supplemental catch (when in a locked condition), for improved security during an attempted breakin.

In a prefered embodiment, a locking device 600 is disclosed, which includes: a lock actuation member 604 operatively coupled with a solenoid 606, the solenoid being adapted to move the lock actuation member to either of a locked state and an unlocked state; a solenoid driver circuit 608 coupled to the solenoid 606 for selectively energizing the solenoid 606, the solenoid driver circuit 608 coupled to receive electrical energy from an energy storage circuit 609; a power supply 610 coupled to selectively provide electrical power to either of the solenoid driver circuit 608 and the energy storage circuit 609; an input interface 612 adapted to receive a user signal and to provide an output signal in response thereto; and a controller 614 coupled to the input interface 612, the power supply 610, the energy storage circuit 609 and the solenoid driver circuit 608 to cause selective energization of the solenoid 606 in response to the output signal; and a housing 616 including the solenoid 606 and a substantial portion of the lock actuation member 604;

the lock actuation member 604 is operatively coupled with the solenoid 606 through a linkage 626, comprising: a radial member 628 pivotably connected to a proximal section 620 of the housing 616 at a first end 630 and connected to an axial member 632 of the linkage 626 at a second end 634, and the solenoid 606 at a middle section 636 thereof; and the axial member 632 having a near end 642 pivotably connected to the first end 630 of the radial member 628 and a far end 644 connected to a latch 646. The security system 600 is particularly adapted for use with roll down doors 618 and the transportation security industry.

Advantageously, the system and locking device can provide a narrow profile (substantially free from extending into the valuable cargo space of a container), self contained, portable, and minimal power consumption (long battery life) security system, depending on the application.

In one embodiment, the security system includes a driver circuit for energizing a solenoid actuated locking device. The circuit can include a microprocessor, a battery power supply, a boosting circuit and an energy storage circuit. The battery voltage can be stepped up by the boosting circuit and the stepped up voltage can be stored in the energy storage circuit. A solenoid driver circuit including a plurality of transistors arranged in an H-bridge configuration supply energy from the storage circuit to the solenoid under control of the microprocessor. The security system can be retrofited or is factory installable, and is particularly adapted for roll down doors and enclosures.

Although various embodiments of the invention have been shown and described, it should be understood that various modifications and substitutions, as well as rearrangements and combinations of the preceding embodiments, can be made by those skilled in the art.

What is claimed is:

1. A locking device, including:

a lock actuation member operatively coupled with a solenoid, the solenoid being adapted to move the lock actuation member to either of a locked state and an unlocked state;

a solenoid driver circuit coupled to the solenoid for selectively energizing the solenoid, the solenoid driver circuit coupled to receive electrical energy from an energy storage circuit;

a power supply coupled to selectively provide electrical power to either of the solenoid driver circuit and the energy storage circuit;

an input interface adapted to receive a user signal and to provide an output signal in response thereto; and a controller, the controller coupled to the input interface, the power supply, the energy storage circuit and the solenoid driver circuit to cause selective energization of the solenoid in response to the output signal; and a housing including the solenoid and a substantial portion of the lock actuation member;

the lock actuation member is operatively coupled with the solenoid through a linkage, comprising:

a radial member pivotably connected to a proximal section of the housing at a first end and connected to an axial member of the linkage at a second end, and the solenoid at a middle section thereof; and the axial member having a near end pivotably connected to the first end portion of the radial member and a far end connected to a latch.

2. The locking device of claim 1, wherein the linkage includes: the radial member pivotably connected to a proximal section of the housing at a first end and connected to an axial member of the linkage at a second end, and the solenoid at a middle section thereof, the middle section having a slot adapted to receive a pivot pin therein, for providing a pivotable connection of the solenoid with the linkage; and the axial member having a near end pivotably connected to the first end portion of the radial member and a far end connected to a latch and a middle section with longitudinal extending channels, the near end including a top finger and a bottom finger with a slot therebetween, the second end of the radial member being configured to fit substantially between the top and bottom fingers.

3. The locking device of claim 1, wherein the lock actuation member includes a generally triangular latch including:

a substantially circular top section defining a cylindrical socket;

a middle section having an interior connecting member adapted to being connected to a linkage; and an exterior section with a substantially smooth contour.

4. The locking device of claim 1, wherein the lock actuation member includes a generally triangular latch including:

a substantially circular top section defining a cylindrical socket substantially complementarily configured to fit at least partially in a receptical of a distal section of the housing;

a middle section having an interior connecting member adapted to being pivotably connected to a far end of an axial member of a linkage, the far end having a substantially L shaped slot adapted to receive a pivot pin therein, the pivot pin connecting the far end with the interior connecting member; and an exterior section with a substantially smooth contour for locking engagement.

5. The security system of claim 1 wherein the housing includes modular sections comprising a proximal section and a distal section, with a cover.

6. The security system of claim 1 wherein a distal section of the housing includes an adjustment mechanism for securely adjusting the housing with respect to a container wall and roll down door.

7. The security system of claim 1 wherein the housing includes modular sections comprising a proximal section and a distal section having a guide for simplifying movement of a linkage therein.

8. The security system of claim 1 wherein the housing includes modular sections comprising a proximal section with a back cover plate and a distal section securely connected to the proximal section.

9. The security system of claim 1 wherein the lock actuation member is operatively coupled with the solenoid, through a linkage comprising:

the radial member pivotably connected to a proximal section of the housing at a first end and connected to an axial member of the linkage at a second end, and the solenoid at a middle section thereof, the middle section having a slot adapted to receive a pivot pin therein, for providing a pivotable connection of the solenoid with the linkage; and the axial member having a near end pivotably connected to the first end portion of the radial member and a far end connected to a latch, the near end including a top finger and a bottom finger with a slot therebetween, the second end of the radial member being configured to fit substantially between the top and bottom fingers.

10. The security system of claim 1 wherein the lock actuation member is operatively coupled with the solenoid, through a linkage comprising:

the radial member pivotably connected to a proximal section of the housing at a first end and connected to an axial member of the linkage at a second end, and the solenoid at a middle section thereof, the middle section having a slot adapted to receive a pivot pin therein, for providing a pivotable connection of the solenoid with the linkage; and the axial member having a near end pivotably connected to the first end portion of the radial member and a far end connected to a latch and a middle section with longitudinal extending channels, the near end including a top finger and a bottom finger with a slot therebetween, the second end of the radial member being configured to fit substantially between the top and bottom fingers.

* * * * *